US008913928B2

(12) United States Patent
Kawashima

(10) Patent No.: US 8,913,928 B2
(45) Date of Patent: Dec. 16, 2014

(54) DEVELOPING DEVICE AND IMAGE FORMING APPARATUS HAVING DEVELOPER LAYER REGULATING MEMBER

(71) Applicant: OKI Data Corporation, Tokyo (JP)

(72) Inventor: Junichi Kawashima, Tokyo (JP)

(73) Assignee: OKI Data Corporation, Tokyo (JP)

( * ) Notice: Subject to any disclaimer, the term of this patent is extended or adjusted under 35 U.S.C. 154(b) by 89 days.

(21) Appl. No.: 13/628,622

(22) Filed: Sep. 27, 2012

(65) Prior Publication Data

US 2013/0078006 A1 Mar. 28, 2013

(30) Foreign Application Priority Data

Sep. 28, 2011 (JP) ..... 2011-211807

(51) Int. Cl.
*G03G 15/08* (2006.01)

(52) U.S. Cl.
CPC ..... *G03G 15/0818* (2013.01)
USPC ..... 399/279; 399/274; 399/284; 399/286

(58) Field of Classification Search
USPC ..... 399/35, 358, 360, 264, 274, 279, 284, 399/286
See application file for complete search history.

(56) References Cited

U.S. PATENT DOCUMENTS

| | | | | |
|---|---|---|---|---|
| 6,006,060 | A * | 12/1999 | Sato | 399/284 |
| 2006/0275598 | A1* | 12/2006 | Shimamura et al. | 428/323 |
| 2009/0092421 | A1* | 4/2009 | Sato | 399/280 |
| 2010/0232839 | A1* | 9/2010 | Yamaguchi | 399/254 |
| 2012/0134697 | A1* | 5/2012 | Kawashima | 399/55 |

FOREIGN PATENT DOCUMENTS

| | | | |
|---|---|---|---|
| JP | 2000-172067 | A | 6/2000 |
| JP | 2006-301478 | A | 11/2006 |
| JP | 2007-264606 | A | 10/2007 |
| JP | 2010-152024 | A | 7/2010 |

* cited by examiner

*Primary Examiner* — G. M. Hyder
(74) *Attorney, Agent, or Firm* — Kubotera & Associates, LLC

(57) ABSTRACT

A developing device includes a developer supporting member having an elastic layer and a surface layer covering the elastic layer for supporting developer; and a developer layer regulating member arranged to abut against the surface layer for regulating a layer thickness of the developer on the surface layer. The surface layer contains at least carbon black. The developer supporting member is configured so that the following equation (1) is satisfied when the surface layer has a dynamic friction coefficient μ between 0.4 and 0.9 ($0.4 \leq \mu \leq 0.9$) and a ten-point average roughness Rz (μm) between 2 μm and 6 μm ($2 \leq Rz \leq 6$):

$$2 \leq C \leq 0.5 \times Rz + 3 \quad (1)$$

where C is a content of the carbon black (weight parts relative to the surface layer of 100).

9 Claims, 17 Drawing Sheets

| No | μ | C | Stain | ΔE | | Vf | | No | μ | C | Stain | ΔE | | Vf | |
|---|---|---|---|---|---|---|---|---|---|---|---|---|---|---|---|
| 1 | 0.4 | 1 | × | 1.40 | ○ | 1.01 | ○ | 28 | 0.4 | 5 | ○ | 3.80 | △ | 1.00 | ○ |
| 2 | 0.6 | 1 | × | 1.49 | ○ | 1.22 | ○ | 29 | 0.6 | 5 | ○ | 3.98 | △ | 1.01 | ○ |
| 3 | 0.8 | 1 | × | 1.60 | ○ | 1.48 | △ | 30 | 0.8 | 5 | ○ | 3.70 | △ | 1.03 | ○ |
| 4 | 1.0 | 1 | × | 1.52 | ○ | 1.87 | × | 31 | 1.0 | 5 | ○ | 3.85 | △ | 1.25 | ○ |
| 5 | 1.2 | 1 | × | 1.67 | ○ | 2.30 | × | 32 | 1.2 | 5 | ○ | 3.72 | △ | 1.51 | △ |
| 6 | 1.4 | 1 | × | 1.51 | ○ | 2.84 | × | 33 | 1.4 | 5 | ○ | 3.65 | △ | 1.85 | × |
| 7 | 1.6 | 1 | × | 1.42 | ○ | 3.50 | × | 34 | 1.6 | 5 | ○ | 3.96 | △ | 2.35 | × |
| 8 | 1.8 | 1 | × | 1.47 | ○ | 4.00 | × | 35 | 1.8 | 5 | ○ | 3.58 | △ | 2.92 | × |
| 9 | 2.0 | 1 | × | 1.38 | ○ | 4.90 | × | 36 | 2.0 | 5 | ○ | 3.59 | △ | 3.54 | × |
| 10 | 0.4 | 2 | ○ | 1.73 | ○ | 1.02 | ○ | 37 | 0.4 | 7 | ○ | 6.26 | × | 1.00 | ○ |
| 11 | 0.6 | 2 | ○ | 1.90 | ○ | 1.12 | ○ | 38 | 0.6 | 7 | ○ | 6.30 | × | 1.02 | ○ |
| 12 | 0.8 | 2 | ○ | 1.68 | ○ | 1.35 | ○ | 39 | 0.8 | 7 | ○ | 6.23 | × | 1.00 | ○ |
| 13 | 1.0 | 2 | ○ | 1.73 | ○ | 1.70 | × | 40 | 1.0 | 7 | ○ | 6.01 | × | 1.03 | ○ |
| 14 | 1.2 | 2 | ○ | 1.70 | ○ | 2.05 | × | 41 | 1.2 | 7 | ○ | 6.75 | × | 1.18 | ○ |
| 15 | 1.4 | 2 | ○ | 1.78 | ○ | 2.60 | × | 42 | 1.4 | 7 | ○ | 6.66 | × | 1.46 | △ |
| 16 | 1.6 | 2 | ○ | 1.86 | ○ | 3.10 | × | 43 | 1.6 | 7 | ○ | 5.89 | × | 1.84 | × |
| 17 | 1.8 | 2 | ○ | 1.68 | ○ | 3.70 | × | 44 | 1.8 | 7 | ○ | 6.13 | × | 2.25 | × |
| 18 | 2.0 | 2 | ○ | 1.77 | ○ | 4.49 | × | 45 | 2.0 | 7 | ○ | 6.45 | × | 2.80 | × |
| 19 | 0.4 | 3 | ○ | 2.20 | ○ | 1.00 | ○ | 46 | 0.4 | 10 | ○ | 11.60 | × | 1.00 | ○ |
| 20 | 0.6 | 3 | ○ | 2.30 | ○ | 1.01 | ○ | 47 | 0.6 | 10 | ○ | 12.00 | × | 1.01 | ○ |
| 21 | 0.8 | 3 | ○ | 2.22 | ○ | 1.23 | ○ | 48 | 0.8 | 10 | ○ | 11.70 | × | 1.01 | ○ |
| 22 | 1.0 | 3 | ○ | 2.40 | ○ | 1.46 | △ | 49 | 1.0 | 10 | ○ | 11.20 | × | 1.02 | ○ |
| 23 | 1.2 | 3 | ○ | 2.10 | ○ | 1.84 | × | 50 | 1.2 | 10 | ○ | 12.30 | × | 1.00 | ○ |
| 24 | 1.4 | 3 | ○ | 2.52 | ○ | 2.34 | × | 51 | 1.4 | 10 | ○ | 11.68 | × | 1.08 | ○ |
| 25 | 1.6 | 3 | ○ | 2.34 | ○ | 2.90 | × | 52 | 1.6 | 10 | ○ | 11.08 | × | 1.35 | ○ |
| 26 | 1.8 | 3 | ○ | 2.18 | ○ | 3.42 | × | 53 | 1.8 | 10 | ○ | 11.70 | × | 1.67 | × |
| 27 | 2.0 | 3 | ○ | 2.50 | ○ | 4.08 | × | 54 | 2.0 | 10 | ○ | 11.50 | × | 2.05 | × |

FIG. 15

| No | C | Rz | Stain | ΔE | | No | C | Rz | Stain | ΔE | |
|---|---|---|---|---|---|---|---|---|---|---|---|
| 55 | 1 | 2 | × | 2.72 | ○ | 75 | 5 | 2 | ○ | 5.00 | × |
| 56 | 1 | 3 | × | 2.12 | ○ | 76 | 5 | 3 | ○ | 4.40 | × |
| 57 | 1 | 4 | × | 1.52 | ○ | 77 | 5 | 4 | ○ | 3.80 | △ |
| 58 | 1 | 5 | × | 0.92 | ○ | 78 | 5 | 5 | ○ | 3.20 | ○ |
| 59 | 1 | 6 | × | 0.32 | ○ | 79 | 5 | 6 | ○ | 2.60 | ○ |
| 60 | 2 | 2 | ○ | 2.96 | ○ | 80 | 6 | 2 | ○ | 6.12 | × |
| 61 | 2 | 3 | ○ | 2.36 | ○ | 81 | 6 | 3 | ○ | 5.52 | × |
| 62 | 2 | 4 | ○ | 1.76 | ○ | 82 | 6 | 4 | ○ | 4.92 | × |
| 63 | 2 | 5 | ○ | 1.16 | ○ | 83 | 6 | 5 | ○ | 4.32 | × |
| 64 | 2 | 6 | ○ | 0.56 | ○ | 84 | 6 | 6 | ○ | 3.72 | △ |
| 65 | 3 | 2 | ○ | 3.42 | ○ | 85 | 7 | 2 | ○ | 7.46 | × |
| 66 | 3 | 3 | ○ | 2.82 | ○ | 86 | 7 | 3 | ○ | 6.86 | × |
| 67 | 3 | 4 | ○ | 2.22 | ○ | 87 | 7 | 4 | ○ | 6.26 | × |
| 68 | 3 | 5 | ○ | 1.62 | ○ | 88 | 7 | 5 | ○ | 5.66 | × |
| 69 | 3 | 6 | ○ | 1.02 | ○ | 89 | 7 | 6 | ○ | 5.06 | × |
| 70 | 4 | 2 | ○ | 3.99 | △ | 90 | 10 | 2 | ○ | 12.80 | × |
| 71 | 4 | 3 | ○ | 3.50 | ○ | 91 | 10 | 3 | ○ | 12.20 | × |
| 72 | 4 | 4 | ○ | 2.90 | ○ | 92 | 10 | 4 | ○ | 11.50 | × |
| 73 | 4 | 5 | ○ | 2.30 | ○ | 93 | 10 | 5 | ○ | 11.00 | × |
| 74 | 4 | 6 | ○ | 1.70 | ○ | 94 | 10 | 6 | ○ | 10.40 | × |

FIG. 19

| No | C | Rz | Ch | ΔE | | No | C | Rz | Ch | ΔE | | No | C | Rz | Ch | ΔE | |
|---|---|---|---|---|---|---|---|---|---|---|---|---|---|---|---|---|---|
| 60 | 2 | 2 | -900 | 1.76 | ○ | 62 | 2 | 4 | -900 | 0.56 | ○ | 64 | 2 | 6 | -900 | 0.02 | ○ |
| 60 | 2 | 2 | -950 | 2.36 | ○ | 62 | 2 | 4 | -950 | 1.16 | ○ | 64 | 2 | 6 | -950 | 0.30 | ○ |
| 60 | 2 | 2 | -1000 | 2.96 | ○ | 62 | 2 | 4 | -1000 | 1.76 | ○ | 64 | 2 | 6 | -1000 | 0.56 | ○ |
| 60 | 2 | 2 | -1050 | 3.56 | △ | 62 | 2 | 4 | -1050 | 2.36 | ○ | 64 | 2 | 6 | -1050 | 1.16 | ○ |
| 60 | 2 | 2 | -1100 | 4.16 | × | 62 | 2 | 4 | -1100 | 2.96 | ○ | 64 | 2 | 6 | -1100 | 1.76 | ○ |
| 60 | 2 | 2 | -1150 | 4.76 | × | 62 | 2 | 4 | -1150 | 3.56 | △ | 64 | 2 | 6 | -1150 | 2.36 | ○ |
| 65 | 3 | 2 | -900 | 2.22 | ○ | 62 | 2 | 4 | -1200 | 4.16 | × | 64 | 2 | 6 | -1200 | 2.96 | ○ |
| 65 | 3 | 2 | -950 | 2.82 | ○ | 62 | 2 | 4 | -1250 | 4.76 | × | 64 | 2 | 6 | -1250 | 3.56 | △ |
| 65 | 3 | 2 | -1000 | 3.42 | ○ | 67 | 3 | 4 | -900 | 1.02 | ○ | 64 | 2 | 6 | -1300 | 4.16 | × |
| 65 | 3 | 2 | -1050 | 4.02 | △ | 67 | 3 | 4 | -950 | 1.62 | ○ | 69 | 3 | 6 | -900 | 0.20 | ○ |
| 65 | 3 | 2 | -1100 | 4.62 | × | 67 | 3 | 4 | -1000 | 2.22 | ○ | 69 | 3 | 6 | -950 | 0.42 | ○ |
| 65 | 3 | 2 | -1150 | 5.22 | × | 67 | 3 | 4 | -1050 | 2.82 | ○ | 69 | 3 | 6 | -1000 | 1.02 | ○ |
| 70 | 4 | 2 | -900 | 2.90 | ○ | 67 | 3 | 4 | -1100 | 3.42 | ○ | 69 | 3 | 6 | -1050 | 1.62 | ○ |
| 70 | 4 | 2 | -950 | 3.50 | ○ | 67 | 3 | 4 | -1150 | 4.02 | × | 69 | 3 | 6 | -1100 | 2.22 | ○ |
| 70 | 4 | 2 | -1000 | 4.10 | × | 67 | 3 | 4 | -1200 | 4.62 | × | 69 | 3 | 6 | -1150 | 2.82 | ○ |
| 70 | 4 | 2 | -1050 | 4.70 | × | 72 | 4 | 4 | -900 | 1.70 | ○ | 69 | 3 | 6 | -1200 | 3.42 | ○ |
| 75 | 5 | 2 | -900 | 3.80 | △ | 72 | 4 | 4 | -950 | 2.30 | ○ | 69 | 3 | 6 | -1250 | 4.02 | × |
| 75 | 5 | 2 | -950 | 4.40 | × | 72 | 4 | 4 | -1000 | 2.90 | ○ | 69 | 3 | 6 | -1300 | 4.62 | × |
| 75 | 5 | 2 | -1000 | 5.00 | × | 72 | 4 | 4 | -1050 | 3.50 | ○ | 74 | 4 | 6 | -900 | 0.50 | ○ |
| 80 | 6 | 2 | -900 | 4.92 | × | 72 | 4 | 4 | -1100 | 4.10 | × | 74 | 4 | 6 | -950 | 1.10 | ○ |
| 80 | 6 | 2 | -950 | 5.52 | × | 72 | 4 | 4 | -1150 | 4.70 | × | 74 | 4 | 6 | -1000 | 1.70 | ○ |
| 85 | 7 | 2 | -900 | 6.26 | × | 77 | 5 | 4 | -900 | 2.60 | ○ | 74 | 4 | 6 | -1050 | 2.30 | ○ |
| 85 | 7 | 2 | -950 | 6.86 | × | 77 | 5 | 4 | -950 | 3.20 | ○ | 74 | 4 | 6 | -1100 | 2.90 | ○ |
| 61 | 2 | 3 | -900 | 1.16 | ○ | 77 | 5 | 4 | -1000 | 3.80 | △ | 74 | 4 | 6 | -1150 | 3.50 | ○ |
| 61 | 2 | 3 | -950 | 1.76 | ○ | 77 | 5 | 4 | -1050 | 4.40 | × | 74 | 4 | 6 | -1200 | 4.10 | × |
| 61 | 2 | 3 | -1000 | 2.36 | ○ | 77 | 5 | 4 | -1100 | 5.00 | × | 74 | 4 | 6 | -1250 | 4.70 | × |
| 61 | 2 | 3 | -1050 | 2.96 | ○ | 82 | 6 | 4 | -900 | 3.72 | △ | 79 | 5 | 6 | -900 | 1.40 | ○ |
| 61 | 2 | 3 | -1100 | 3.56 | △ | 82 | 6 | 4 | -950 | 4.32 | × | 79 | 5 | 6 | -950 | 2.00 | ○ |
| 61 | 2 | 3 | -1150 | 4.16 | × | 82 | 6 | 4 | -1000 | 4.92 | × | 79 | 5 | 6 | -1000 | 2.60 | ○ |
| 61 | 2 | 3 | -1200 | 4.76 | × | 87 | 7 | 4 | -900 | 5.06 | × | 79 | 5 | 6 | -1050 | 3.20 | ○ |
| 66 | 3 | 3 | -900 | 1.62 | ○ | 87 | 7 | 4 | -950 | 5.66 | × | 79 | 5 | 6 | -1100 | 3.80 | △ |
| 66 | 3 | 3 | -950 | 2.22 | ○ | 63 | 2 | 5 | -900 | 0.20 | ○ | 79 | 5 | 6 | -1150 | 4.40 | × |
| 66 | 3 | 3 | -1000 | 2.82 | ○ | 63 | 2 | 5 | -950 | 0.56 | ○ | 79 | 5 | 6 | -1200 | 5.00 | × |
| 66 | 3 | 3 | -1050 | 3.42 | ○ | 63 | 2 | 5 | -1000 | 1.16 | ○ | 84 | 6 | 6 | -900 | 2.52 | ○ |
| 66 | 3 | 3 | -1100 | 4.02 | × | 63 | 2 | 5 | -1050 | 1.76 | ○ | 84 | 6 | 6 | -950 | 3.12 | ○ |
| 66 | 3 | 3 | -1150 | 4.62 | × | 63 | 2 | 5 | -1100 | 2.36 | ○ | 84 | 6 | 6 | -1000 | 3.72 | △ |
| 71 | 4 | 3 | -900 | 2.30 | ○ | 63 | 2 | 5 | -1150 | 2.96 | ○ | 84 | 6 | 6 | -1050 | 3.99 | △ |
| 71 | 4 | 3 | -950 | 2.90 | ○ | 63 | 2 | 5 | -1200 | 3.56 | △ | 84 | 6 | 6 | -1100 | 4.92 | × |
| 71 | 4 | 3 | -1000 | 3.50 | △ | 63 | 2 | 5 | -1250 | 4.16 | × | 89 | 7 | 6 | -900 | 3.86 | △ |
| 71 | 4 | 3 | -1050 | 4.10 | × | 63 | 2 | 5 | -1300 | 4.76 | × | 89 | 7 | 6 | -950 | 4.46 | × |
| 71 | 4 | 3 | -1100 | 4.70 | × | 68 | 3 | 5 | -900 | 0.42 | ○ | 89 | 7 | 6 | -1000 | 5.06 | × |
| 76 | 5 | 3 | -900 | 3.20 | ○ | 68 | 3 | 5 | -950 | 1.02 | ○ | | | | | | |
| 76 | 5 | 3 | -950 | 3.80 | △ | 68 | 3 | 5 | -1000 | 1.62 | ○ | | | | | | |
| 76 | 5 | 3 | -1000 | 4.40 | × | 68 | 3 | 5 | -1050 | 2.22 | ○ | | | | | | |
| 76 | 5 | 3 | -1050 | 5.00 | × | 68 | 3 | 5 | -1100 | 2.82 | ○ | | | | | | |
| 81 | 6 | 3 | -900 | 4.32 | × | 68 | 3 | 5 | -1150 | 3.42 | ○ | | | | | | |
| 81 | 6 | 3 | -950 | 4.92 | × | 68 | 3 | 5 | -1200 | 4.02 | × | | | | | | |
| 86 | 7 | 3 | -900 | 5.66 | × | 68 | 3 | 5 | -1250 | 4.62 | × | | | | | | |
| 86 | 7 | 3 | -950 | 6.26 | × | 73 | 4 | 5 | -900 | 1.10 | ○ | | | | | | |
| | | | | | | 73 | 4 | 5 | -950 | 1.70 | ○ | | | | | | |
| | | | | | | 73 | 4 | 5 | -1000 | 2.30 | ○ | | | | | | |
| | | | | | | 73 | 4 | 5 | -1050 | 2.90 | ○ | | | | | | |
| | | | | | | 73 | 4 | 5 | -1100 | 3.50 | ○ | | | | | | |
| | | | | | | 73 | 4 | 5 | -1150 | 4.10 | × | | | | | | |
| | | | | | | 73 | 4 | 5 | -1200 | 4.70 | × | | | | | | |
| | | | | | | 78 | 5 | 5 | -900 | 2.00 | ○ | | | | | | |
| | | | | | | 78 | 5 | 5 | -950 | 2.60 | ○ | | | | | | |
| | | | | | | 78 | 5 | 5 | -1000 | 3.20 | ○ | | | | | | |
| | | | | | | 78 | 5 | 5 | -1050 | 3.80 | △ | | | | | | |
| | | | | | | 78 | 5 | 5 | -1100 | 4.40 | × | | | | | | |
| | | | | | | 78 | 5 | 5 | -1150 | 5.00 | × | | | | | | |
| | | | | | | 83 | 6 | 5 | -900 | 3.12 | ○ | | | | | | |
| | | | | | | 83 | 6 | 5 | -950 | 3.72 | △ | | | | | | |
| | | | | | | 83 | 6 | 5 | -1000 | 4.32 | × | | | | | | |
| | | | | | | 83 | 6 | 5 | -1050 | 4.92 | × | | | | | | |
| | | | | | | 88 | 7 | 5 | -900 | 4.46 | × | | | | | | |
| | | | | | | 88 | 7 | 5 | -950 | 5.06 | × | | | | | | |

FIG. 24

DEVELOPING DEVICE AND IMAGE FORMING APPARATUS HAVING DEVELOPER LAYER REGULATING MEMBER

BACKGROUND OF THE INVENTION AND RELATED ART STATEMENT

The present invention relates to a developing device and an image forming apparatus.

In general, a conventional image forming apparatus of an electro-photography type includes a conventional developing device. The conventional developing device includes a photosensitive member as an image supporting member; a charging roller for uniformly charging a surface of the photosensitive drum; a developing roller as a developer supporting member for attaching toner as developer to a static latent image formed on the surface of the photosensitive drum to develop the static latent image; a supply roller as a developer supplying member for supplying toner to the developing roller; a developing blade as a developer layer regulating member for regulating a toner layer thickness on a surface of the developing roller; and the like.

In the conventional developing device of the conventional image forming apparatus, the developing roller is provided for attaching toner as developer to the static latent image formed on the surface of the photosensitive drum to develop the static latent image. The developing roller may include a surface layer (refer to Patent Reference).

Patent Reference: Japanese Patent Publication No. 2010-152024

According to Patent Reference, in the conventional developing device of the conventional image forming apparatus with the configuration described above, toner particles and an outer additive separated from the toner particles may be attached or fixed to the surface of the developing roller, thereby causing a phenomenon called toner filming. When the toner filming occurs, it is difficult to perform a printing operation with high quality.

In view of the problems described above, an object of the present invention is to provide a developing device and an image forming apparatus capable of solving the problems of the conventional developing device. In the present invention, it is possible to prevent toner particles and an outer additive separated from the toner particles from being attached or fixed to a surface of a developing roller, thereby preventing the toner filming.

Further objects and advantages of the invention will be apparent from the following description of the invention.

SUMMARY OF THE INVENTION

In order to attain the objects described above, according to a first aspect of the present invention, a developing device includes a developer supporting member having an elastic layer and a surface layer covering the elastic layer for supporting developer; and a developer layer regulating member arranged to abut against the surface layer for regulating a layer thickness of the developer on the surface layer. The surface layer contains at least carbon black.

According to the first aspect of the present invention, the developer supporting member is configured so that the following equation (1) is satisfied when the surface layer has a dynamic friction coefficient μ between 0.4 and 0.9 ($0.4 \le \mu \le 0.9$) and a ten-point average roughness Rz (μm) between 2 μm and 6 μm ($2 \le Rz \le 6$):

$$2 \le C \le 0.5 \times Rz + 3 \quad (1)$$

where C is a content of the carbon black (weight parts relative to the surface layer of 100), or the developer supporting member is configured so that the following equation (2) is satisfied when the surface layer has the dynamic friction coefficient μ and the ten-point average roughness Rz satisfy the following equation (3):

$$0.9 \le \mu \le 0.05 \times Rz + 1 \quad (2)$$

$$10 \times \mu - 7 \le C \le 0.5 \times Rz + 3 \quad (3)$$

According to a second aspect of the present invention, a developing device includes a developer supporting member having an elastic layer and a surface layer covering the elastic layer for supporting developer; a developer layer regulating member arranged to abut against the surface layer for regulating a layer thickness of the developer on the surface layer; an image supporting member for supporting a static latent image having the layer thickness thus regulated; a charging member for charging a surface of the image supporting member; and a voltage applying unit for applying a voltage Ch (V) to the charging member. The surface layer contains at least carbon black.

According to the second aspect of the present invention, the developer supporting member is configured so that the following equations (4) and (5) are satisfied when the surface layer has a ten-point average roughness Rz (μm) between 2 μm and 6 μm ($2 \le Rz \le 6$):

$$-50 \times Rz - 950 \le Ch \le -25 \times Rz - 900 \quad (4)$$

$$2 \le C \le 0.02Ch + Rz + 21 \quad (5)$$

where C is the content of the carbon black (weight parts relative to the surface layer of 100).

According to a third aspect of the present invention, an image forming apparatus includes the developing device in the first aspect or the second aspect; a transfer unit for transferring a developer image developed with the developing device to a recording medium; and a transportation unit for transporting the recording medium to the transfer unit.

In the developing device and the image forming apparatus of the present invention, it is possible to prevent toner particles and an outer additive separated from the toner particles from being attached or fixed to a surface of a developing roller, thereby preventing the toner filming.

BRIEF DESCRIPTION OF THE DRAWINGS

FIG. 15 is a schematic view showing a table of evaluation results of stain, fog, and toner filming according to the first embodiment of the present invention;

FIG. 19 is a schematic view showing a table of evaluation results of the stain and the fog according to the first embodiment of the present invention;

FIG. 24 is a schematic view showing a table of evaluation results of fog according to a second embodiment of the present invention;

DETAILED DESCRIPTION OF PREFERRED EMBODIMENTS

Hereunder, embodiments of the present invention will be explained with reference to the accompanying drawings. It should be noted that the present invention is not limited to the following description, and the embodiments can be modified within a scope of the present invention.

First Embodiment

Figure 1:
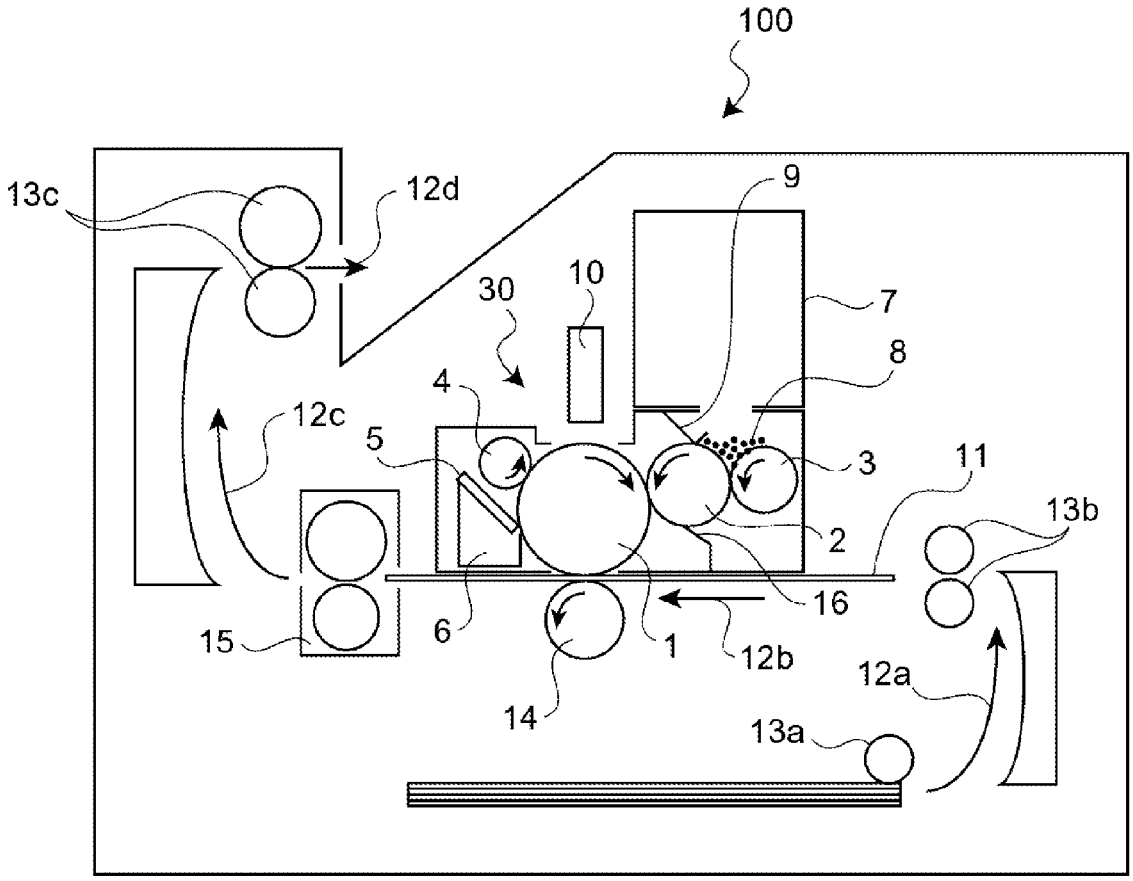
FIG. 1 is a schematic sectional view showing a configuration of a printer according to a first embodiment of the present invention.

A first embodiment of the present invention will be explained. First, a printer 100 will be explained as an image forming apparatus having a developing device 30 to which the present invention is applied. FIG. 1 is a schematic sectional view showing a configuration of the printer 100 according to the first embodiment of the present invention. The printer 100 is the image forming apparatus capable of forming an image on a sheet 11 with an electro-photography method.

As shown in FIG. 1, the printer 100 includes a transportation path (12*a*, 12*b*, 12*c*, and 12*d*) extending from a sheet transportation roller 13*a* as a starting point to a sheet transportation roller 13*c* as an ending point through a sheet transportation roller 13*b*. The transportation path (12*a*, 12*b*, 12*c*, and 12*d*) is formed in an S character shape. The printer 100 further includes the developing device 30, a transfer roller 14 as a transfer unit, a fixing device 15 and the like arranged along the transportation path (12*a*, 12*b*, 12*c*, and 12*d*).

In the embodiment, the developing device 30 is disposed along the transportation path 12*a* to be detachable. Further, after an exposure device 10 irradiates irradiation light on a surface of a photosensitive drum 1 as an image supporting member to form a static latent image thereon, the developing device 30 is configured to attach toner 8 as developer to the static latent image, thereby developing the static latent image to form a toner image as a developer image. The developing device 30 will be explained in more detail later.

In the embodiment, the exposure device 10 includes an LED (Light Emitting Diode) head formed of an LED element and a lens array. Further, the exposure device 10 is arranged such that the irradiation light irradiated from the LED element according to image data is focused to form the image on the surface of the photosensitive drum 1.

In the embodiment, the transfer roller 14 is formed of a conductive rubber and the like, and is arranged to face and press against the photosensitive drum 1. When a transfer roller power source 22 (described later) applies a bias voltage to the transfer roller 14, the transfer roller 14 transfers the toner image developed on the surface of the photosensitive drum 1 to the sheet 11.

In the embodiment, the fixing device 15 is disposed on a downstream side of the developing device 30 along the transportation path 12*b*. Further, the fixing device 15 includes a heat roller, a backup roller, and a thermistor.

In the embodiment, the heat roller is formed of a core metal, a heat resistance elastic layer, and a PFA (perfluoroethylene-perfluoro alkylvinylether copolymer) tube. The core metal is formed of aluminum and the like, and is formed in a hollow cylindrical shape. The heat resistance elastic layer is formed of a silicon rubber, and is disposed to cover the core metal. The PFA tube is disposed to cover the heat resistance elastic layer. A heating heater such as a halogen lamp and the like is disposed inside the core metal.

In the embodiment, the backup roller includes a heat roller, a backup roller, and a thermistor. The heat roller is formed of a core metal, a heat resistance elastic layer, and a PFA tube. The core metal is formed of aluminum and the like. The heat resistance elastic layer is formed of a silicon rubber, and is disposed to cover the core metal. The PFA tube is disposed to cover the heat resistance elastic layer. Further, the backup roller is arranged to form a nip portion between the backup roller and the heat roller.

In the embodiment, the thermistor is disposed near the heat roller in a non-contact state as a surface temperature detection unit of the heat roller. The fixing device 15 is configured such that the heating heater is controlled according to a detection result of a surface temperature of the heat roller detected with the thermistor, so that the surface temperature of the heat roller is maintained at a specific temperature. After the toner image is transferred to the sheet 11, when the sheet 11 passes through the nip portion between the heat roller and the backup roller, heat and pressure are applied to the sheet 11, so that toner on the sheet 11 is melted and the toner image is fixed.

In the embodiment, although not shown in FIG. 1, the printer 100 further includes a CPU (Central Processing Unit) functioning as a control unit 20 (refer to FIG. 2); an ROM (Read Only Memory) for storing a control program and the like to control an operation of the printer 100; an RAM (Random Access Memory) used as a working area of the CPU; various interface units for receiving the image data, a control command, and the like; and an image data editing memory for receiving print data received through the interface unit and storing the image data generated through editing the print data.

In the embodiment, although not shown in FIG. 1, the printer 100 further includes a display unit having a display portion such as an LC (Liquid Crystal Display) and the like for displaying a state of the printer 100; an operation unit having an input portion such as a touch panel and the like for receiving an input of a user; and various sensors such as a sheet position detection sensor, a density sensor, and the like for monitoring an operational state of the printer 100.

In the embodiment, although not shown in FIG. 1, the printer 100 further includes a head drive control unit for outputting the image data stored in the image data editing memory to the exposure device 10, and for controlling a drive of the LED head disposed in the exposure device 10; a temperature control unit for controlling the temperature of the fixing device 15; a sheet transportation motor control unit for controlling a drive motor to rotate the sheet transportation rollers 13*a*, 13*b*, and 13*c* for transporting the sheet 11 along the sheet transportation path (12*a*, 12*b*, 12*c*, and 12*d*); a drive control unit for controlling a drive motor to rotate various rollers such as the photosensitive drum 1 and the like; and the like.

Figure 2:
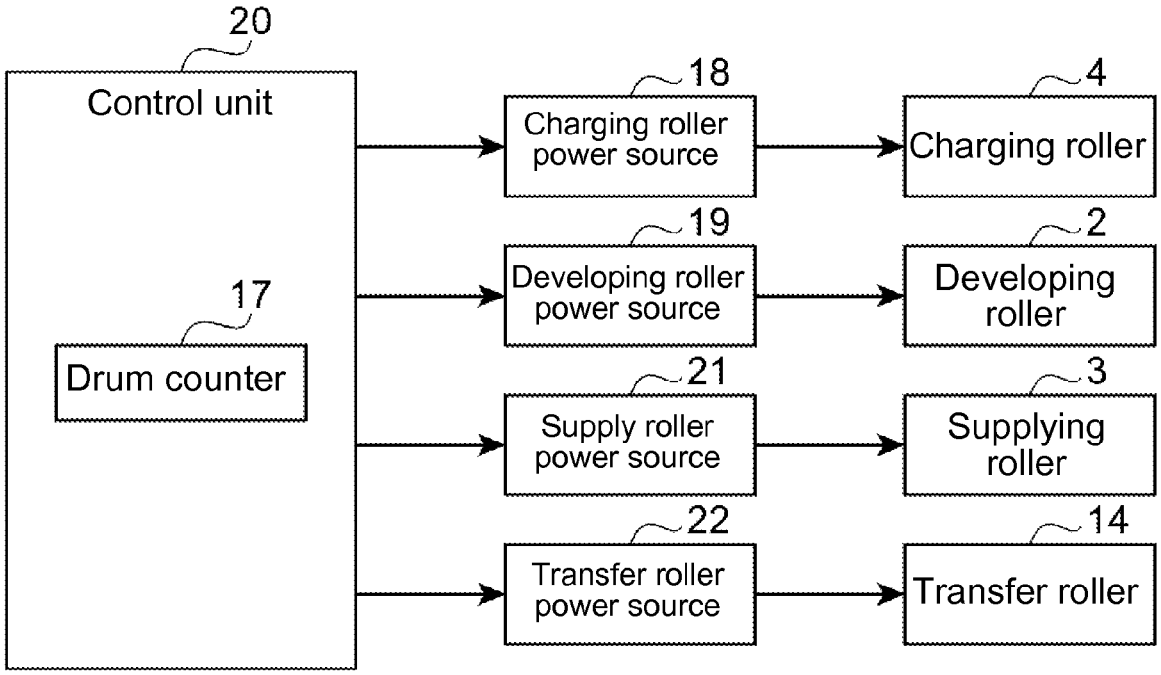
FIG. 2 is a block diagram showing the configuration of the printer according to the first embodiment of the present invention.

The configuration of the printer 100 will be explained in more detail. FIG. 2 is a block diagram showing the configuration of the printer 100 according to the first embodiment of the present invention.

As shown in FIG. 2, the printer 100 includes the control unit 20; a charging roller power source 18 as a voltage application unit; a developing roller power source 19; a supply roller power source 21; and the transfer roller power source 22.

In the embodiment, the control unit 20 is provided for collectively controlling an entire operation of the printer 100. Further, the control unit 20 includes a drum counter 17 for measuring a rotation number of the photosensitive drum 1.

In the embodiment, the charging roller power source 18 is provided for applying a specific voltage to the charging roller 4 according to an instruction of the control unit 20, so that the surface of the photosensitive drum 1 is constantly and uniformly charged.

In the embodiment, the developing roller power source 19 is provided for applying a specific voltage to the developing roller 2 as the developer supporting member, so that the developing roller 2 attaches the toner 8 to the static latent image formed on the photosensitive drum 1 to develop the toner image.

In the embodiment, the supply roller power source 21 is provided for applying a specific voltage to the supplying roller 3 as the developer supply member, so that the supplying roller 3 supplies the toner 8 to the developing roller 2.

In the embodiment, the transfer roller power source 22 is provided for applying a specific voltage to the transfer roller 14, so that the transfer roller 14 transfers the toner image formed on the photosensitive drum 1 to the sheet 11.

The developing device 30 will be explained in more detail next.

As shown in FIG. 1, the developing device 30 includes the photosensitive drum 1 arranged as the image supporting member to be rotatable in an arrow direction; the developing roller 2 arranged as the developer supporting member to face the photosensitive drum 1 and be rotatable in an arrow direction; the supplying roller 3 arranged as the developer supplying member to face the developing roller 2 and be rotatable in an arrow direction; and the charging roller 4 arranged on an upstream side of the photosensitive drum 1 in a rotational direction thereof.

Further, the developing device 30 includes a cleaning blade 5 arranged to contact with a specific location of the surface of the photosensitive drum 1; a space 6 disposed at a specific position for collecting waste toner scraped off with the cleaning blade 5; a toner cartridge 7 disposed above the supplying roller 3 for storing a specific amount of the toner 8; a developing blade 9 supported on an housing inner wall of the developing device 30 as a developer layer thickness regulating member so that an edge portion thereof contacts with a specific location of the developing roller 2; and a sealing member 16 for preventing the toner 8 from leaking from the developing roller 2.

In the embodiment, the photosensitive drum 1 is formed of a conductive supporting member and an optical conductive layer. More specifically, the photosensitive drum 1 is an organic photosensitive member, in which an electric charge generation layer and an electric charge transportation layer are sequentially laminated as the optical conductive layer on the conductive supporting member formed of a metal tube of aluminum and the like. The photosensitive drum 1 is provided for forming the static latent image according to the image data through the irradiation light irradiated from the exposure device 10.

In the embodiment, the conductive supporting member of the photosensitive drum 1 is formed of an aluminum tube having a thickness of 0.75 mm and an outer diameter of 30 mm. Further, the electric charge generation layer having a film thickness of 0.5 mm and the electric charge transportation layer having a film thickness of 18 μm are disposed on the aluminum tube.

In the embodiment, the charge generation layer contains a charge generation material. The charge generation material may include, for example, an inorganic photoconductive material such as selenium and an alloy thereof, selenium arsenic compound, cadmium sulfide, zinc oxide, and the like; and an organic dye or pigment such as phthalocyanine, azodye, quinacridone, polycyclic quinone, pyrylium salt, thiapyrylium salt, indigo, thio-indigo, anthoanthron, pyranethron, cyanine, and the like.

In the embodiment, the charge transportation layer contains a charge transportation material. The charge transportation material may include, for example, a heterocyclic compound such as carbazole, indole, imidazole, oxazole, pyrazole, oxadiazole, pyrazoline, thiadiazole, and the like; an aniline derivative; a hydrazone compound; an aromatic amine derivative; a stilbene derivative; and an electron supplying material such as a polymerized compound having a main chain or a side chain formed of at least one of these compounds.

Figure 3:
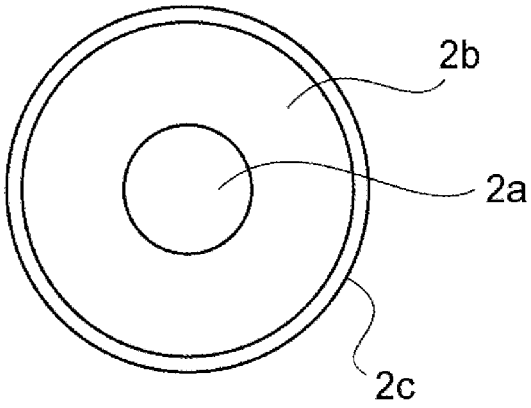
FIG. 3 is a schematic sectional view showing a developing roller of a developing device of the printer according to the first embodiment of the present invention.

FIG. 3 is a schematic sectional view showing the developing roller 2 of the developing device 30 of the printer 100 according to the first embodiment of the present invention.

As shown in FIG. 3, the developing roller 2 includes a conductive shaft 2*a* as a core metal formed of stainless steel and the like, and an elastic layer 2*b* disposed on a circumference of the conductive shaft 2*a*. Further, a surface layer 2*c* is disposed on the elastic layer 2*b* for charging the toner 8.

In the embodiment, the elastic layer 2*b* is formed of, for example, a polyether type urethane resin. Further, the elastic layer 2*b* contains an electron conductive agent such as carbon black (for example, acetylene black, Ketjen black, and the like) and non-conductive inorganic particles such as calcium carbonate and silica for adjusting a resistivity level and reinforcement. It is preferred that the elastic layer 2*b* has an Asker hardness C between 68° and 80°. The Asker C hardness indicating the hardness of the elastic layer 2*b* may be measured with an Asker hardness meter (a product of KOBUNSHI KEIKI Co., Ltd., in which a pressure prove needle of the hardness meter contacts with a top of an outer circumference of the developing roller 2.

In the embodiment, the surface layer 2*c* is formed through immersing into a urethane solution, in which a urethane resin is dissolved in a specific solvent, so that the urethane solution is infiltrated on the elastic layer 2*b*. When the surface layer 2*c* is formed of the urethane resin, it is possible to obtain high electric conductivity. In particular, it is possible to prevent a resistivity of the developing roller 2 from increasing with time. Further, the surface layer 2*c* contains carbon black for imparting conductivity and an additive of a fluorine type or a silicone type for adjusting a dynamic friction coefficient μ of the surface of the surface layer 2*c*.

In the embodiment, it is preferred that the surface of the surface layer 2*c* has a ten-point average roughness Rz (μm) between 2 and 6 μm according to JIS B0601-199. The ten-point average roughness Rz may be measured with Surfcoder SEF3500 (a product of Kosaka Laboratory Ltd.). When the ten-point average roughness Rz is measured, a prove needle diameter of the surface roughness measurement device is 2 μm. Further, a prove needle pressure is 0.7 mN, and a moving speed of the prove needle is 0.1 mm/sec.

In the embodiment, the developing roller 2 formed of the conductive shaft 2*a*, the elastic layer 2*b*, and the surface layer 2*c* is formed in a straight shape. A roller rubber portion of the developing roller 2 has an outer diameter ϕs of 19.6 mm. The conductive shaft 2*a* has an outer diameter ϕs of 12.0 mm, and a roller rubber portion thereof has a length of 348 mm.

Figure 4:
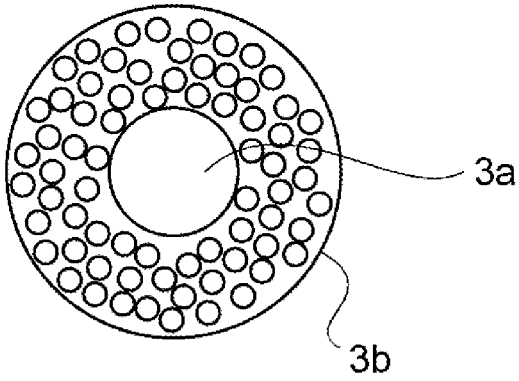
FIG. 4 is a schematic sectional view showing a supplying roller of the developing device of the printer according to the first embodiment of the present invention.

FIG. 4 is a schematic sectional view showing the supplying roller 3 of the developing device 30 of the printer 100 according to the first embodiment of the present invention.

As shown in FIG. 4, the supplying roller 3 is formed of a conductive shaft 3*a* as a core metal and an elastic layer 3*b* disposed on a circumference of the conductive shaft 3*a*. The conductive shaft 3*a* is formed of an SUM member having an outer diameter ϕs of 6.0 mm, and non-electrolytic plating is applied to the SUM member.

Figure 5:
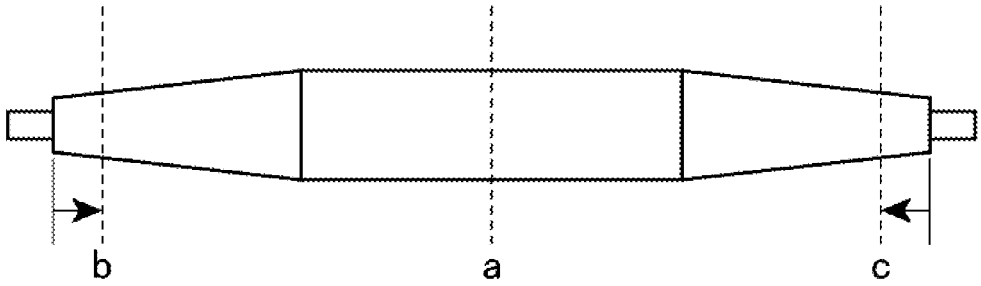
FIG. 5 is a schematic plan view showing the supplying roller of the developing device of the printer according to the first embodiment of the present invention.

FIG. 5 is a schematic plan view showing the supplying roller 3 of the developing device 30 of the printer 100 according to the first embodiment of the present invention.

As shown in FIG. 5, the elastic layer 3*b* is formed of a conductive silicone rubber foamed member, and has a crown shape, in which an outer diameter at an end portion thereof in a longitudinal direction thereof is larger than an outer diameter at a center portion thereof. More specifically, the outer diameter ϕs at the center portion is 15.7 mm. Further, a ratio of the outer diameter ϕs at the end portion thereof in the longitudinal direction thereof relative to the outer diameter ϕs at the center portion is 0.975 (in FIG. 5, the outer diameter b/the outer diameter a ≈ the outer diameter c/the outer diameter a=0.975). Further, the elastic layer 3*b* has a roller rubber portion having a length of 336 mm.

In the elastic layer 3*b*, the foamed member has a density depending on a foaming ratio and an average cell diameter, and the density of the foamed member is not limited to a specific level. It is preferred that the average cell diameter of the foamed member is between 200 and 500 μm. It is noted that the average cell diameter can be adjusted through controlling an amount and a type of a foaming agent including an inorganic foaming agent such as sodium bicarbonate and the like, an organic foaming agent such as azodicarbonamide (ADCA) and the like. Further, the average cell diameter can be adjusted through controlling a vulcanization time and a vulcanization temperature. For example, when the amount of the foaming agent is increased, the vulcanization time is prolonged, or the vulcanization temperature is increased, it is possible to increase the average cell diameter of the foamed member.

In the embodiment, the elastic layer 3*b* contains an electron conductive agent such as carbon black and the like for imparting semi-conductivity. When the supplying roller 3 is produced, the following steps are conducted. First, the conductive shaft 3*a* is washed with an organic solvent and the like for removing an oily component. Then, the conductive shaft 3*a* is integrated with the conductive silicone rubber foamed member as the elastic layer 3*b* with a protrusion forming machine. In the next step, the conductive silicone rubber foamed member is foamed and cured in an infrared oven and the like. Afterward, a secondary vulcanization is performed at a temperature between about 180 and 225° C. for 5 to 10 hours. Lastly, the supplying roller 3 is obtained after a rough polishing process and a finisher polishing process and the like are performed, so that the supplying roller 3 has a desirable outer diameter.

In the embodiment, the charging roller 4 is arranged to contact with the surface of the photosensitive drum 1. The charging roller 4 is formed of, for example, a conductive shaft of stainless steel and the like and a conductive elastic member of an epichlorohydrin rubber and the like for covering the conductive shaft. When the charging roller power source 18 applies the specific voltage to the charging roller 4, the charging roller 4 is configured to charge the surface of the photosensitive drum 1 uniformly and constantly.

In the embodiment, the cleaning blade 5 is arranged to contact with a specific contact location on the surface of the photosensitive drum 1, so that the cleaning blade 5 scrapes off transfer remaining toner remaining on the surface of the photosensitive drum 1 when the photosensitive drum 1 is rotated.

In the embodiment, the space 6 is provided for accommodating a transportation unit for transporting the toner 8. After the cleaning blade 5 scrapes off the transfer remaining toner, the transportation unit transports the transfer remaining toner to a collection container (not shown) as waste toner. The toner cartridge 7 is a box-shape member for collecting the toner 8 unused for forming the image.

In the embodiment, the toner 8 may includes synthesized toner produced with a suspension polymerization method or an emulsion polymerization method. When the toner 8 is produced, first, a styrene-acryl-copolymer produced with the emulsion polymerization method is mixed with a colorant and wax to produce toner particles (base toner) through agglomeration. Then, silica and titanium oxide fine particles are added and mixed with the toner particles in a mixer. The toner 8 thus processed has a circularity degree between 0.95 and 0.97 and a particle diameter between 5.5 μm and 7.0 μm.

In the embodiment, the developing blade 9 is arranged to contact with a specific location on the surface of the developing roller 2 with a specific pressing force in a counter direction. The developing blade 9 as the developer layer regulating member is formed of stainless steel and has a plate thickness of 0.08 mm.

Figure 6:
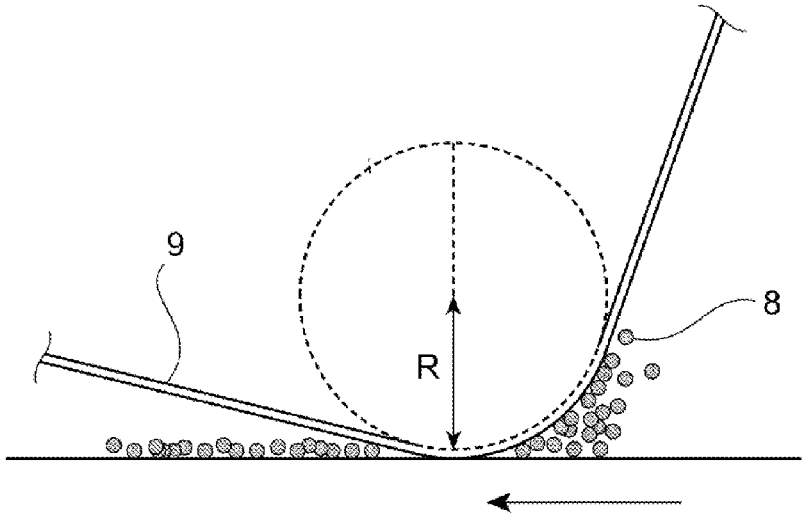
FIG. 6 is a schematic side view showing a developing blade arranged to abut against the developing roller of the developing device of the printer according to the first embodiment of the present invention.

FIG. 6 is a schematic side view showing the developing blade 9 arranged to abut against the developing roller 2 of the developing device 30 of the printer 100 according to the first embodiment of the present invention.

As shown in FIG. 6, the developing blade 9 is pressed against the surface of the developing roller 2 at an edge portion thereof with a linear pressure per unit length of 40 gf/cm, so that the developing blade 9 regulates the layer thickness of the toner 8 at a constant level. The edge portion (the contact portion) of the developing blade 9 has a curvature radius R of 0.275 mm.

In the embodiment, the sealing member 16 is formed of, for example, a foamed urethane member, and is formed in a circular shape having a thickness of about 3 mm corresponding to the shape of the developing roller 2. Further, the sealing member 16 has a sliding portion sliding against the developing roller 2, and the sliding portion is formed in a film shape made of polytetrafluoroethylene (PTFE) and has a thickness of about 0.08 mm. In addition to the film shape, the sliding portion may be formed of a felt member of woven fibers.

A printing operation of the printer 100 having the configuration described above will be explained next. First, when an upper device such as a personal computer and the like inputs a print execution command through an interface (not shown), the control unit 20 controls a drive control unit (not shown) to rotate the photosensitive drum 1 in the arrow direction in FIG. 1 at a specific circumferential speed.

At the same time, the control unit 20 sends an instruction to the charging roller power source 18, so that the charging roller power source 18 applies the specific voltage to the charging roller 4. When the charging roller power source 18 receives the instruction, the charging roller power source 18 applies the specific voltage to the charging roller 4, so that the charging roller 4 charges the surface of the photosensitive drum 1 uniformly and constantly. In the embodiment, the charging roller power source 18 is configured to apply a voltage of about 100 V to the charging roller 4 (under an NN environment, a temperature of 20° C., a humidity of 50%). It is noted that the NN environment represents an environment under a normal temperature and a normal humidity.

In the next step, the control unit 20 outputs the image data corresponding to the image data thus input to a head drive control unit (not shown). Accordingly, the head drive control unit controls the LED head disposed in the exposure device 10 to irradiate light according to the image data thus input, so that the static latent image is formed on the photosensitive drum 1.

At this moment, the supply roller power source 21 applies the specific voltage to the supplying roller 3, so that the supplying roller 3 supplies the toner 8 retained in the toner cartridge 7 to the developing roller 2. In the embodiment, the supply roller power source 21 is configured to apply a voltage of about −300 V to the supplying roller 3.

In the next step, the developing blade 9 disposed at the specific location of the surface of the supplying roller 3 forms the constant layer thickness of the toner 8 supplied from the supplying roller 3. Accordingly, the toner 8 is attached to an area of the static latent image through an electrical force line corresponding to the static latent image formed on the photosensitive drum 1, thereby developing the toner image. In the embodiment, a direct current voltage of about −150 V is applied to the developing roller 2.

While the toner image is being formed, the control unit 20 sends an instruction to a sheet transportation motor control unit (not shown) to rotate the sheet transportation rollers 13*a*, 13*b* and 13*c*. When the sheet transportation rollers 13*a*, 13*b* and 13*c* are rotated, the sheet 11 is transported to the developing device 30 through the sheet transportation paths 12*a* and 12*b*.

In the next step, the transfer roller power source 22 applies the specific voltage to the transfer roller 14, so that the transfer roller 14 transfers the toner image to the sheet 11. In the embodiment, the transfer roller power source 22 applies a voltage of about +2,800 V to the transfer roller 14, so that the developer image developed on the photosensitive drum 1 with the developing device 30 is transferred to the sheet 11 thus transported. Afterward, the sheet 11 is transported to the fixing device 15. In the fixing device 15, the heat roller applies heat to melt the toner 8, and the sheet 11 is pressed at the nip portion between the heat roller and the backup roller. Accordingly, the toner image is fixed to the sheet 11.

After the toner image is fixed to the sheet 11, the sheet transportation roller 13*c* is rotated to discharge the sheet 11 outside the printer 100 through the sheet transportation paths 12*c* and 12*d*, thereby completing the printing operation.

In the embodiment, after the toner image is transferred, a small amount of the toner 8 may remain on the photosensitive drum 1. In this case, the cleaning blade 5 removes the remaining toner to clean the photosensitive drum 1, so that the photosensitive drum 1 can be used repeatedly.

When the toner 8 is the synthesized toner produced with the suspension polymerization method or the emulsion polymerization method as described above, the toner filming may occur, thereby deteriorating text quality. In the following description, the developing roller 2 used for an evaluation will be explained. Further, an evaluation method for evaluating a measure to prevent the toner filming will be explained as well.

First, the developing roller 2 used for the evaluation will be explained. Table 1 shows various examples of the developing roller 2 having different values of the dynamic friction coefficient μ, and an amount C (weight part) of the carbon black contained in the surface layer 2*a*. It is noted that C represents the content of the carbon black as weight parts relative to a weight of the urethane resin as a main component in the surface layer 2*c* being 100.

TABLE 1

| Example No. | μ | C |
|---|---|---|
| 1 | 0.4 | 1 |
| 2 | 0.6 | 1 |
| 3 | 0.8 | 1 |

TABLE 1-continued

| Example No. | μ | C |
|---|---|---|
| 4 | 1.0 | 1 |
| 5 | 1.2 | 1 |
| 6 | 1.4 | 1 |
| 7 | 1.6 | 1 |
| 8 | 1.8 | 1 |
| 9 | 2.0 | 1 |
| 10 | 0.4 | 2 |
| 11 | 0.6 | 2 |
| 12 | 0.8 | 2 |
| 13 | 1.0 | 2 |
| 14 | 1.2 | 2 |
| 15 | 1.4 | 2 |
| 16 | 1.6 | 2 |
| 17 | 1.8 | 2 |
| 18 | 2.0 | 2 |
| 19 | 0.4 | 3 |
| 20 | 0.6 | 3 |
| 21 | 0.8 | 3 |
| 22 | 1.0 | 3 |
| 23 | 1.2 | 3 |
| 24 | 1.4 | 3 |
| 25 | 1.6 | 3 |
| 26 | 1.8 | 3 |
| 27 | 2.0 | 3 |
| 28 | 0.4 | 5 |
| 29 | 0.6 | 5 |
| 30 | 0.8 | 5 |
| 31 | 1.0 | 5 |
| 32 | 1.2 | 5 |
| 33 | 1.4 | 5 |
| 34 | 1.6 | 5 |
| 35 | 1.8 | 5 |
| 36 | 2.0 | 5 |
| 37 | 0.4 | 7 |
| 38 | 0.6 | 7 |
| 39 | 0.8 | 7 |
| 40 | 1.0 | 7 |
| 41 | 1.2 | 7 |
| 42 | 1.4 | 7 |
| 43 | 1.6 | 7 |
| 44 | 1.8 | 7 |
| 45 | 2.0 | 7 |
| 46 | 0.4 | 10 |
| 47 | 0.6 | 10 |
| 48 | 0.8 | 10 |
| 49 | 1.0 | 10 |
| 50 | 1.2 | 10 |
| 51 | 1.4 | 10 |
| 52 | 1.6 | 10 |
| 53 | 1.8 | 10 |
| 54 | 2.0 | 10 |

In the evaluation, the various examples of the developing roller 2 were prepared through adjusting the amounts of the silicone-type additive and the fluorine-type additive, so that the various examples of the developing roller 2 had different dynamic friction coefficients μ. It was noted that when the dynamic friction coefficient μ was too small, it was found to be difficult to obtain a sufficient image density. On the other hand, when the dynamic friction coefficient μ was too large, it was found to be difficult to scrape off the toner 8 remaining on the developing roller 2 with the supplying roller 3.

Figure 7:
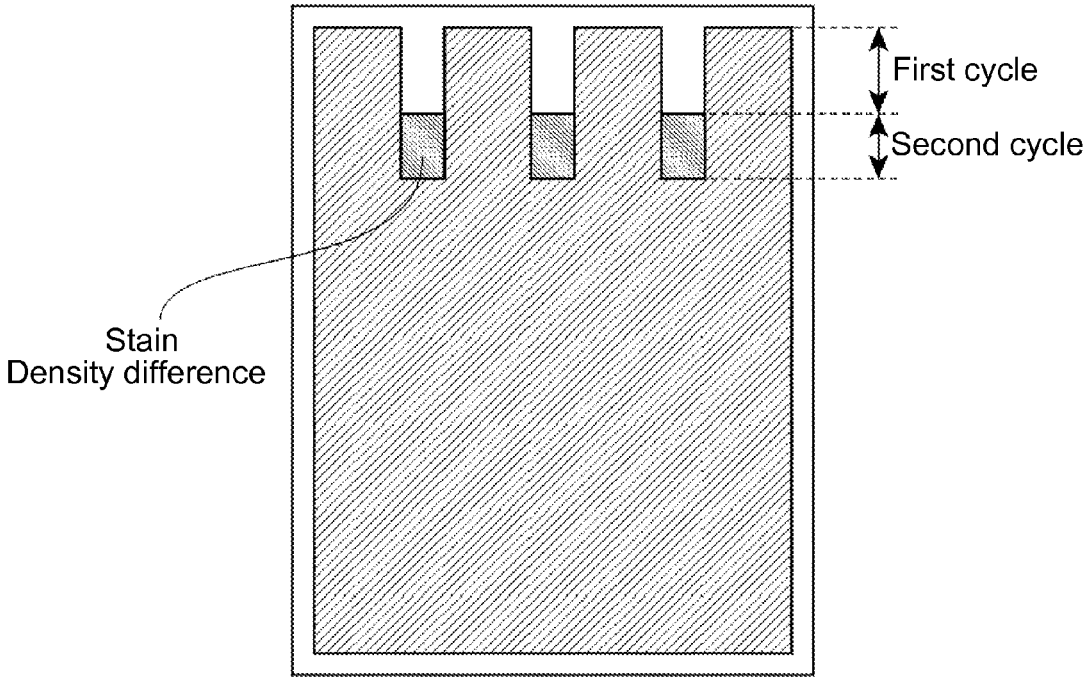
FIG. 7 is a schematic view showing an example of a printed sheet exhibiting various states of stain according to a dynamic friction coefficient of the developing roller of the printer.

FIG. 7 is a schematic view showing an example of a printed sheet exhibiting various states of stain according to the dynamic friction coefficient μ of the developing roller 2 of the printer 100.

When the dynamic friction coefficient μ of the developing roller 2 was increased, an amount of the toner 8 attached to the developing roller 2 was increased. In general, when the developing roller 2 develops the toner image on the photosensitive drum 1, the supplying roller 3 scrapes off the toner 8 that is not used for developing the toner image. When the supplying roller 3 properly scrapes off the toner 8 that is not used for developing, the amount of the toner 8 attached to the developing roller 2 is maintained at the same level as the first cycle after the second cycle, thereby preventing the stain or the density difference. However, when an excessive amount of the toner 8 is attached to the developing roller 2 in the first cycle, it is difficult to scrape of the toner 8 that is not used for developing with the supplying roller 3. As a result, the toner 8 is newly supplied to the toner 8 remaining on the developing roller 2 in the second cycle, so that the density difference from the first cycle is occurred.

As shown in FIG. 7, when it was difficult to scrape off the toner 8 remaining on the developing roller 2 with the supplying roller 3, the toner 8 tended to be attached in an excessive amount to a portion where the supplying roller 3 did not scrape off the toner 8 effectively in the second cycle of the developing process, thereby causing the stain or the density difference from the first cycle of the developing process. Accordingly, in the evaluation, the dynamic friction coefficient μ of the developing roller 2 was set in a range between 0.4 and 2.0 ($0.4 \leq \mu \leq 2.0$).

Figure 8:
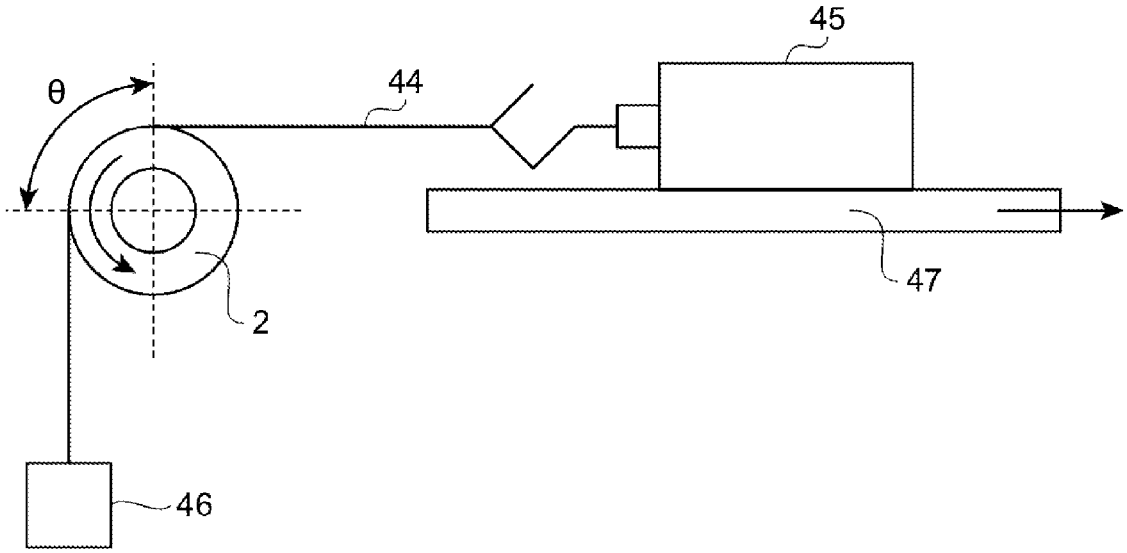
FIG. 8 is a schematic view showing a method of measuring the dynamic friction coefficient of the developing roller of the printer according to the first embodiment of the present invention.

A method of measuring the dynamic friction coefficient μ will be explained next with reference to FIG. 8. FIG. 8 is a schematic view showing a method of measuring the dynamic friction coefficient μ of the developing roller 2 of the printer 100 according to the first embodiment of the present invention.

As shown in FIG. 8, a tension gauge 45 (DIGITALFORCE GAUGE ZP-50N, a product of IMADA CO., LTD.) was fixed to a stage 47 (a product type of SPL42, a product of ORIENTAL MOTOR Co., Ltd.) to be movable in an arrow direction. A belt 44 had a width of 50 mm and a length of 200 mm, and was made in contact with the developing roller 2 fixed at a specific angle θ (90° in the evaluation). One end portion of the belt 44 was connected to the tension gauge 45, and the other end portion of the belt 44 was connected to a weight 46.

In the state described above, the stage 47 was moved at a speed of 1.2 mm/sec. so that the stage 47 slid in an arrow direction in FIG. 8. A load K applied to the tension gauge 45 was measured, so that the dynamic friction coefficient μ was calculated. The belt 44 was an excellent white paper sheet (a product type of PPR-A4NA, a density of 80 g/cm2, a product of Oki Data Corporation). The weight 46 has a weight of 5 g, 10 g, or 15 g.

In the evaluation, the dynamic friction coefficient μ was measured according to the Euler's belt equation defined as follows:

$$\mu = 1/\theta \times 1n\ (K/W)$$

In the evaluation, the dynamic friction coefficient μ was measured using the three types of the weight 46, i.e., 5 g, 10 g, or 15 g. The dynamic friction coefficient μ shown in Table 1 is an average value of the three types of the weight 46.

The evaluation of the various examples of the developing roller 2 shown in Table 1 will be explained next in order to obtain an optimized configuration of the developing roller 2 to minimize the toner filming.

In the evaluation, as the first step, an A3 half-tone image was printed on one sheet at an initial timing for confirming stain. It is preferred to confirm stain at the initial timing, at which charging property of the toner 8 is at the highest level, since the charging property of the toner 8 tends to decline with time. It is noted that when a large amount of the toner 8 is attached to the surface of the developing roller 2, and further a large amount of the toner 8 is developed on the photosensitive drum 1 without the layer thickness of the toner 8 being regulated with the developing blade 9, stain tends to occur.

Figure 9:
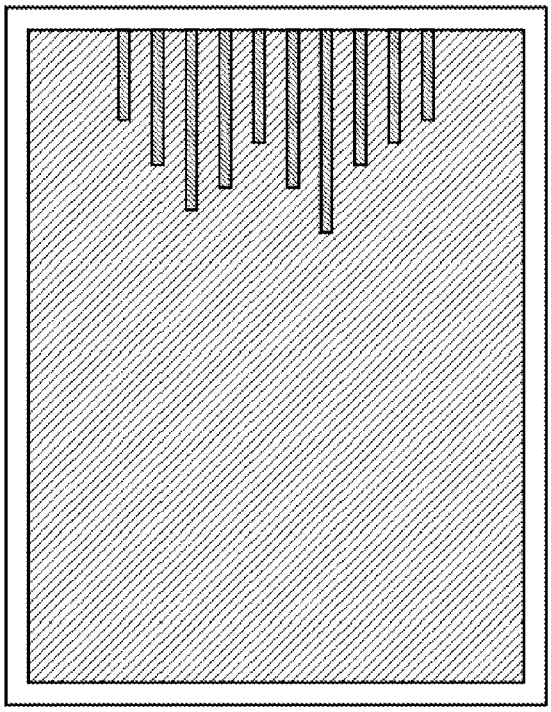
FIG. 9 is a schematic view showing an example of the printed sheet exhibiting a brush stain.

FIG. 9 is a schematic view showing an example of the printed sheet exhibiting a brush stain. When a large amount of the toner 8 is attached to the developing roller 2, it is difficult to scrape off the toner 8 with the developing blade 9, and the toner 8 might pass through the developing blade 9. When a part of the toner 8 passes through the developing blade 9, the part of the toner 8 is developed on the photosensitive drum 1, so that stain tends to occur. When stain occurs, the brush stain as shown in FIG. 9 is prominently observed. Especially, when the developing roller 2 has the high charging property or a large surface roughness, the brush stain tends to occur more frequently.

Figure 10:
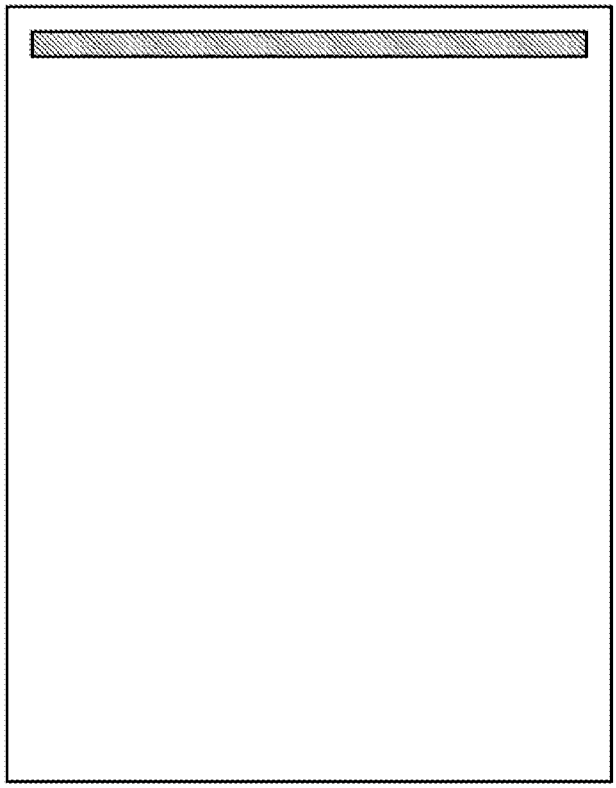
FIG. 10 is a schematic view showing an example of the printed sheet having a duty pattern of 1%.

FIG. 10 is a schematic view showing an example of the printed sheet having a duty pattern of 1%. In the next step, as shown in FIG. 10, an A3 solid printing pattern having the duty pattern of 1% (the 1% duty pattern) was printed on 20,000 sheets of paper. Afterward, the toner 8 and the outer additive were melted and fixed on the surface of the developing roller 2, so that the toner filming was reproduced. It is found that the toner filming tends to occur when the outer additive dispersed in the toner 8 is separated due to a stress through friction between the toner 8 and a component such as the developing blade 9, the developing roller 2, or the supplying roller 3. In this case, the outer additive is accumulated together with the toner 8 on the surface of the developing roller 2, and is melted and fixed to the surface of the developing roller 2. Accordingly, in order for the toner filming to be reproduced, it was necessary to print an image on a certain number of sheets.

In the evaluation, when the 1% duty pattern was printed on 20,000 sheets of paper, the voltage was applied to each component as follows: the voltage of about −150 V was applied to the developing roller 2; the voltage of about −300 V was applied to the supplying roller 3; the voltage of about −1,100 V was applied to the charging roller 4; and the voltage of about −300 V was applied to the developing blade 9. Further, the printer 100 was performed the printing operation at the printing speed of 36 ppm on one side in the case that the sheet was an ordinary normal sheet (the density: 68 to 75 g/cm$^2$). MICROLINE 91 (a product of Oki Data Corporation) was used as the printer 100, and the evaluation environment was the NN environment (the temperature: 22° C., the humidity: 50%). It is noted that the voltage of about −1,000 was applied to the charging roller 4 under the HH environment (the temperature: 28° C., the humidity: 80%).

After the 1% duty pattern was printed on 20,000 sheets of paper, the printer 100 was moved to the HH environment and placed there for 24 hours. Afterward, the printer 100 performed the printing operation on an A3 recording sheet. The developing device 30 was removed at a timing when the A3 recording sheet was situated between the photosensitive drum 1 and the charging roller 4, so that the fog toner was collected as a cause of the fog.

Figure 11:
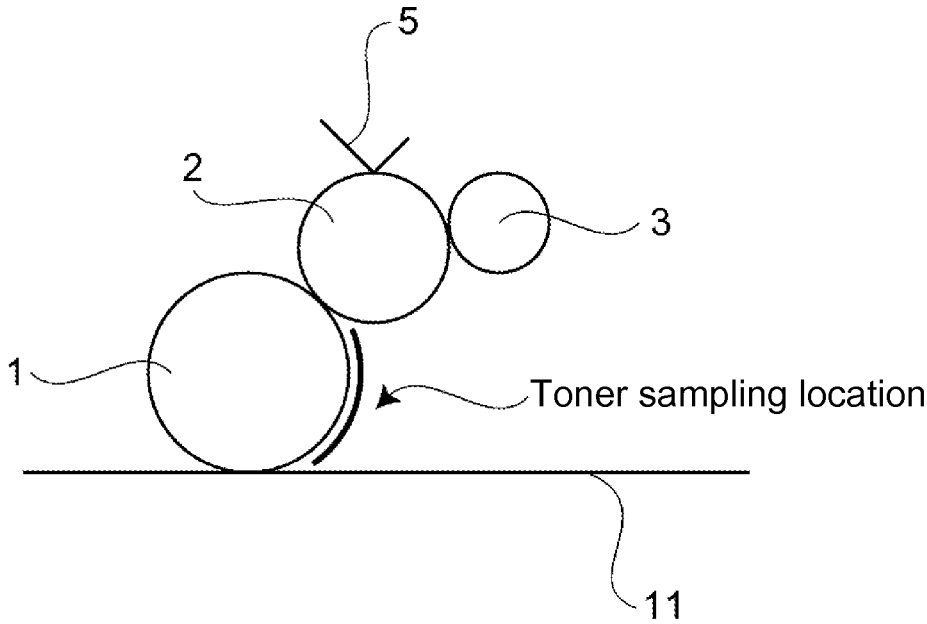
FIG. 11 is a schematic side view showing the developing device of the printer indicating a toner sampling location according to the first embodiment of the present invention.

FIG. 11 is a schematic side view showing the developing device 30 of the printer 100 indicating a toner sampling location according to the first embodiment of the present invention. As shown in FIG. 11, the fog toner was collected at the toner sampling location, which normally was a location after the toner image was developed and before the toner image was transferred.

In the evaluation, the fog toner was collected for the following reason. As explained above in Table 1, the various examples of the developing roller 2 contained the different amounts of the carbon black. In general, carbon black is used as the conductive agent. When the amount of the carbon black is increased, the charging property of the toner 8 tends to be decreased. When the toner 8 with the decreased charging property or charged negatively relative to the toner 8 charged normally is attached to a background portion of the image (that is, a non-printed portion), the fog tends to occur. Further, in general, when the toner charging property is decreased, the fog tends to occur. For the reasons explained above, it is preferred to collect the fog toner for confirming the optimum amount of the carbon black.

Figure 12:
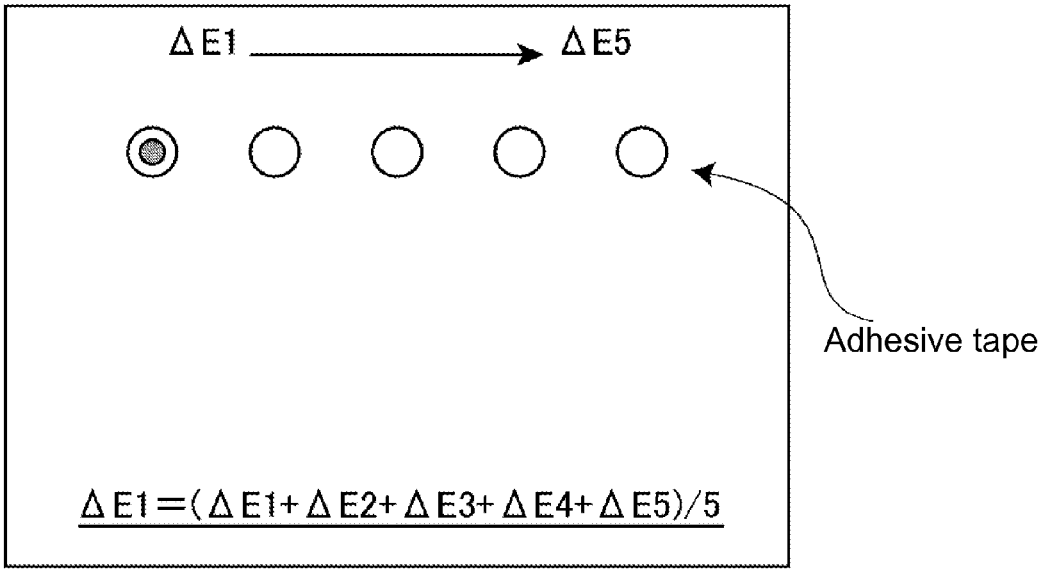
FIG. 12 is a schematic view showing a method of measuring fog according to the first embodiment of the present invention.

A method of measuring the fog will be explained next. FIG. 12 is a schematic view showing the method of measuring the fog according to the first embodiment of the present invention. First, after the toner 8 on the photosensitive drum 1 was attached to an adhesive tape (Scotch Tape, a product of Sumitomo 3M Limited) after the toner image was developed and before the toner image was transferred, the adhesive tape was attached to a white sheet of the recording sheet. Then, a spectrum color measurement device was used to measure a color difference ΔE relative to the case that only the adhesive tape was attached to the recording sheet. In the evaluation, as shown in FIG. 12, the color difference ΔE was measured at five locations evenly spaced from both end portions of the photosensitive drum 1, and an average value was defined as the fog measurement value.

In the next step, the developing roller 2 was removed from the developing device 30. Then, the developing roller 2 was arranged to contact with the photosensitive drum 1, and a voltage was applied to the developing roller 2 while rotating the developing roller 2, so that the toner 8 was removed electrically. After the toner 8 was removed electrically, only the toner 8 melted and fixed and the outer additive remained on the surface of the developing roller 2. In the case that an extent of the toner filming was not good, the toner 8 was melted and fixed in an ugly state, and a blackish color of the toner 8 covered the surface of the developing roller 2.

Figure 13:
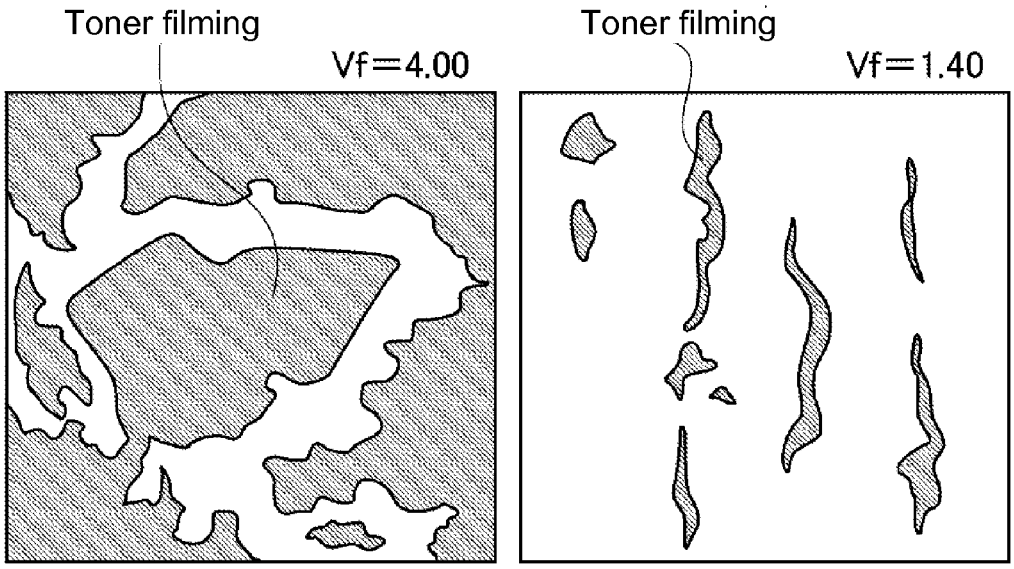
FIG. 13 is a schematic view showing examples of photos of an electron microscope according to the first embodiment of the present invention.

In the state of the toner 8 described above, the surface of the developing roller 2 was observed with an electron microscope. FIG. 13 is a schematic view showing examples of photos of the electron microscope according to the first embodiment of the present invention. As shown in the photo on the left side of FIG. 13, it was observed that the toner 8 melted and fixed and the outer additive occupied a large area relative to the white background under the electron microscope.

A method of measuring a remaining charge V of the developing roller 2 using a dielectric relaxation measurement device 37, so that the state of the toner 8 and the outer additive in the melted and fixed state can be evaluated quantitatively.

Figure 14:
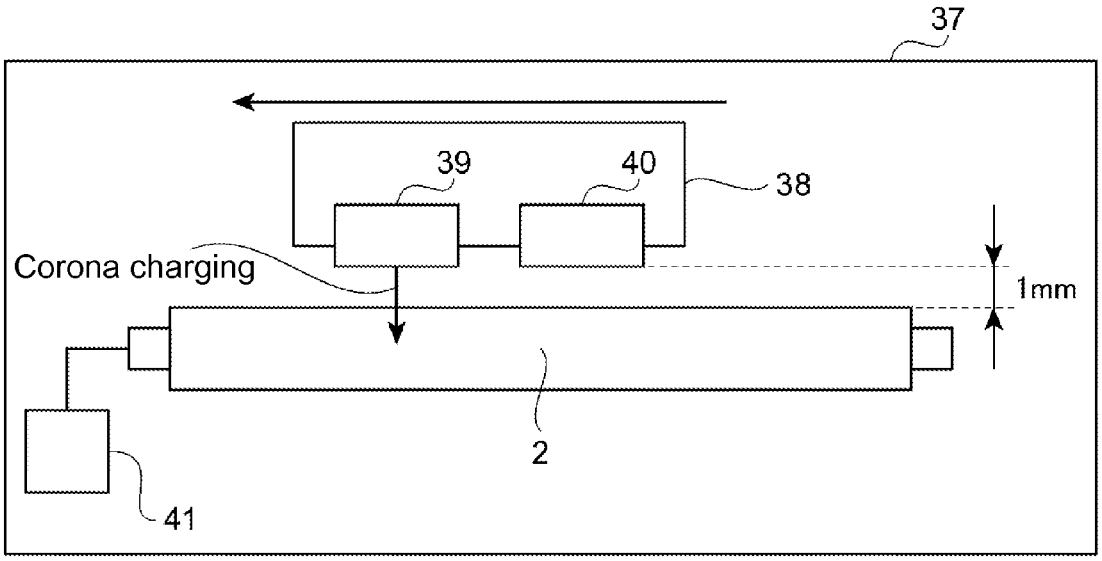
FIG. 14 is a schematic view showing a dielectric measurement device.

FIG. 14 is a schematic view showing the dielectric measurement device 37 used to measure the remaining charge V of the developing roller 2. In the evaluation, DRA-2000L (a product of Quality Engineering Associates Inc.) was used as the dielectric measurement device 37. With the dielectric measurement device 37, after a corona voltage was applied to the surface of the developing roller 2, it was possible to calculate the remaining potential from charges remaining on the surface of the developing roller 2 after a potential was declined. When the remaining potential exhibited a larger value, the remaining charges were large, thereby exhibiting the stronger dielectric property.

As shown in FIG. 14, the dielectric measurement device 37 includes a carrier 38, on which a corona voltage application unit (a corona discharging unit) 39 for applying the corona voltage to the surface of the developing roller 2, and a probe (a surface potential meter) 40 for obtaining the charges on the surface of the developing roller 2 are disposed at specific locations. The carrier 38 is arranged to be freely movable in a longitudinal direction of the developing roller 2.

In the evaluation, the probe 40 was fixed at a position away from the surface of the developing roller 2 by a distance of 1 mm. After a corona voltage application unit 39 applies the corona voltage of 6 kV, the probe 40 measured the remaining charge of the developing roller 2 after 0.1 second with a electric current sensor 41. Every time the carrier 38 moved back and forth between the both end portions of the developing roller 2, the developing roller 2 was rotated by a specific rotational angle and continues the rotational movement until the developing roller 2 was rotated for 360 degrees.

In general, when the extent of the toner filming on the surface of the developing roller 2 becomes worse, the insulation property is increased, thereby increasing the remaining charge (V). In the evaluation, the initial remaining charge V1 (V) of the developing roller 2 and the remaining charge V2 (V) after 20,000 sheets were printed were measured. A ratio Vf of the initial remaining charge V1 and the remaining charge V2 was defined as the quantitative value for determining the toner filming. The ratio Vf was defined with the following equation (1). When the ratio Vf had a larger value, the toner filming was worse.

$$Vf=V2/V1 \quad (1)$$

FIG. 15 is a schematic view showing a table of evaluation results of the stain, the fog, and the toner filming according to the first embodiment of the present invention. In the table shown in FIG. 15, the stain, the fog, and the toner filming were evaluated as follows. The result "Δ" indicates that although the fog and the toner filing were not perfect, it was not problem to print a text.

More specifically, when there was a visible brush stain, the result of the stain was represented as "x", and when there was a visible brush stain, the result of the stain was represented as "○". When the color difference ΔE was greater than 4.00 (ΔE>4.00), the result of the fog was represented as "x". When the color difference ΔE was between 3.50 and 4.00 (3.50<ΔE≤4.00), the result of the fog was represented as "Δ". When the color difference ΔE was equal to or less than 3.50 (ΔE≤3.50), the result of the fog was represented as "○". When the ratio Vf was greater than 1.60 (Vf>1.60), the result of the toner filming was represented as "x". When the ratio Vf was between 1.40 and 1.60 (1.40<Vf≤1.60), the result of the toner filming was represented as "Δ". When the ratio Vf was equal to or less than 1.40 (Vf≤1.40), the result of the toner filming was represented as "○".

Figure 16:
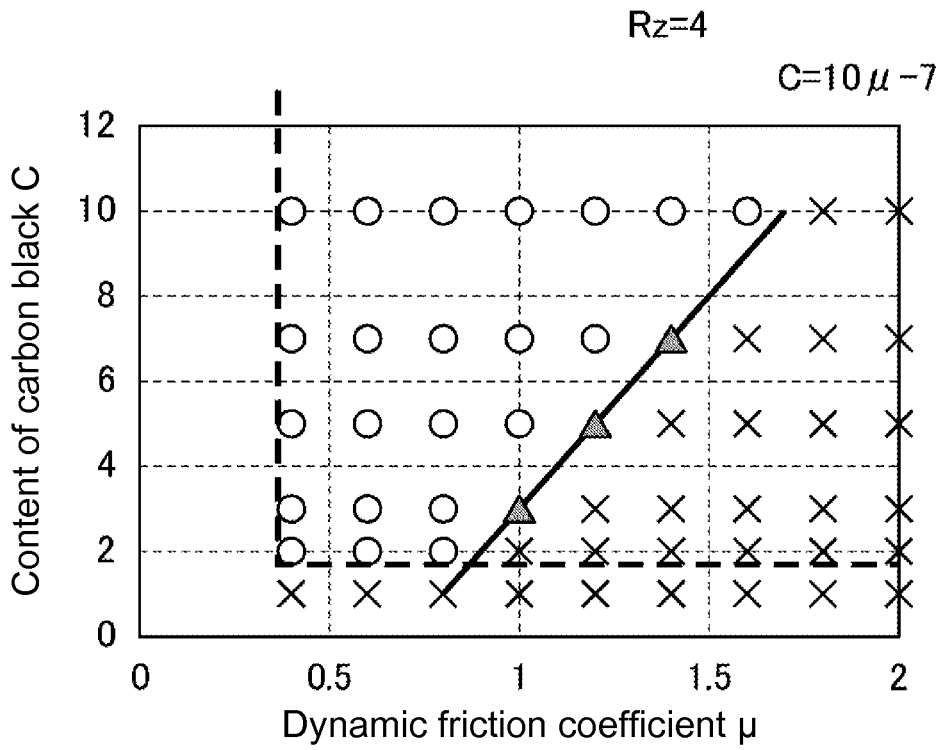
FIG. 16 is a graph showing a relationship between a content of carbon black, the dynamic friction coefficient of the developing roller, and the toner filming when the developing roller has a ten-point average roughness Rz of 4 (μm) (Rz=4) according to the first embodiment of the present invention.

In the evaluation, the ratio Vf between 1.40 and 1.60 (1.40<Vf≤1.60) was defined as a boundary between good and poor. FIG. 16 is a graph showing a relationship between the content C of the carbon black, the dynamic friction coefficient μ of the developing roller 2, and the toner filming when the developing roller 2 had the ten-point average roughness Rz of 4 (μm) (Rz=4) according to the first embodiment of the present invention. The graph shown in FIG. 16 was used for evaluating the toner filming.

Figure 17:
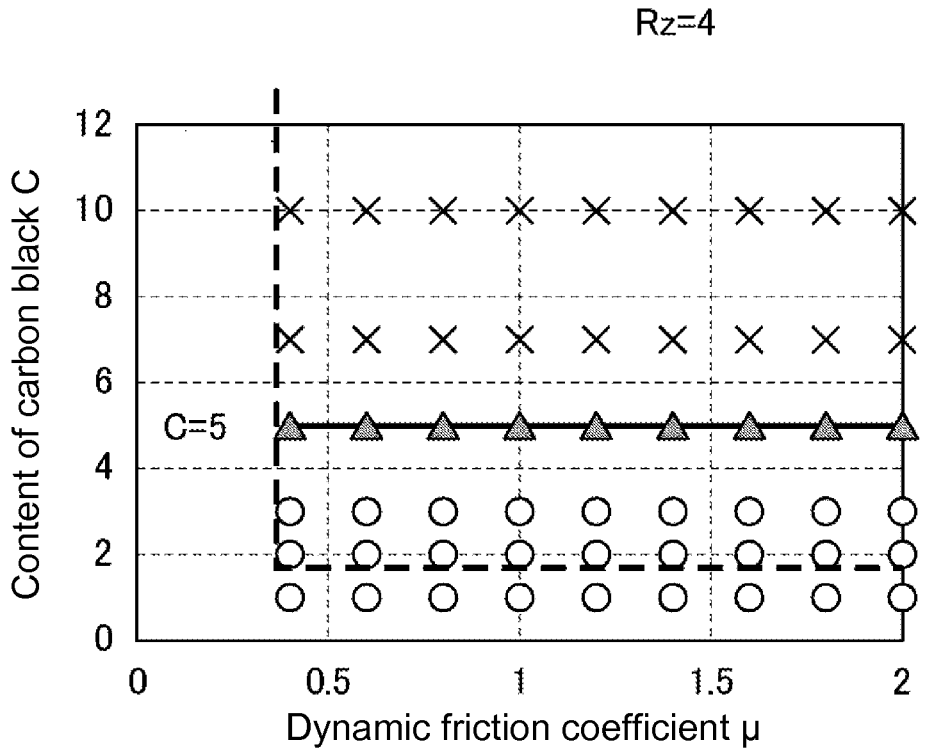
FIG. 17 is a graph showing a relationship between the content of the carbon black, the dynamic friction coefficient of the developing roller, and the fog when the developing roller has the ten-point average roughness Rz of (μm) (Rz=4) according to the first embodiment of the present invention.

FIG. 17 is a graph showing a relationship between the content C of the carbon black, the dynamic friction coefficient μ of the developing roller 2, and the fog when the developing roller 2 had the ten-point average roughness Rz of 4 (μm) (Rz=4) according to the first embodiment of the present invention. As shown in FIG. 17, the fog was not significantly dependent on the dynamic friction coefficient μ, and greatly dependent on the content C of the carbon black.

Figure 18:
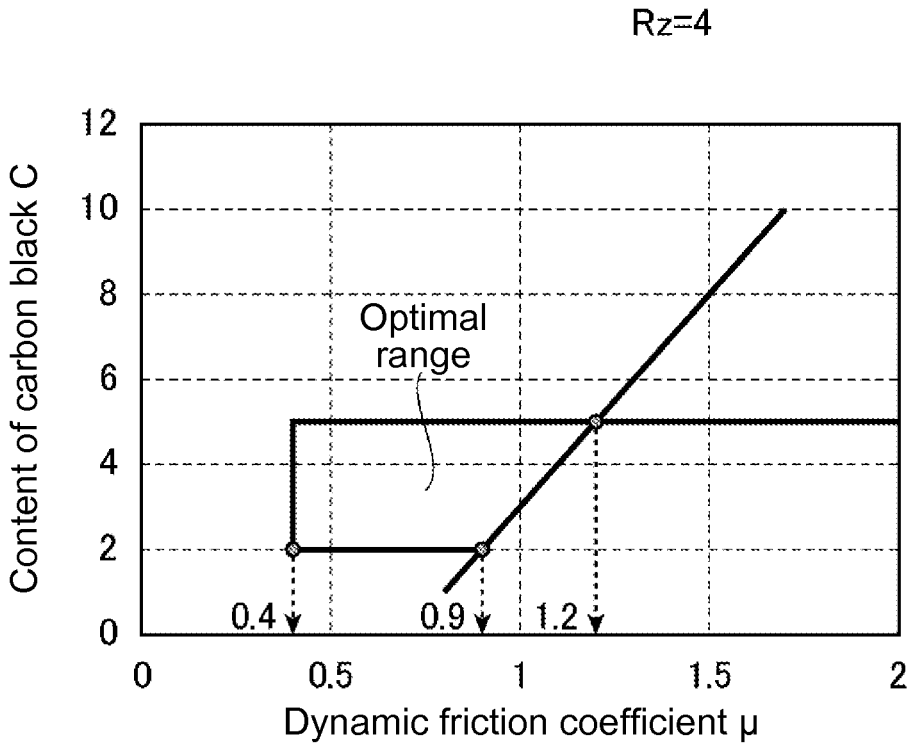
FIG. 18 is a graph showing an optimal range of the content of the carbon black and the dynamic friction coefficient of the developing roller when the developing roller has the ten-point average roughness Rz of 4 (μm) (Rz=4) according to the first embodiment of the present invention.

FIG. 18 is a graph showing an optimal range of the content C of the carbon black and the dynamic friction coefficient μ of the developing roller 2 when the developing roller 2 had the ten-point average roughness Rz of 4 (μm) (Rz=4) according to the first embodiment of the present invention.

As shown in FIG. 18, the relationship between the content C of the carbon black and the dynamic friction coefficient μ of the developing roller 2 can be expressed with the following equation (2). As shown in FIG. 18, although the fog was not significantly dependent on the dynamic friction coefficient μ relative to the content C of the carbon black, when the dynamic friction coefficient μ became less than 0.4, the fog occurred regardless of the content C of the carbon black.

$$(0.4\leq\mu\leq0.9)2\leq C\leq5$$

$$(0.9\leq\mu\leq1.2)10\times\mu-7\leq C\leq5 \quad (2)$$

Table 2 shows various examples of the developing roller 2 having different values of the amount C (weight part) and the ten-point average roughness Rz.

TABLE 2

| Example No. | C | Rz |
|---|---|---|
| 55 | 1 | 2 |
| 56 | 1 | 3 |
| 57 | 1 | 4 |
| 58 | 1 | 5 |
| 59 | 1 | 6 |
| 60 | 2 | 2 |
| 61 | 2 | 3 |
| 62 | 2 | 4 |
| 63 | 2 | 5 |
| 64 | 2 | 6 |
| 65 | 3 | 2 |
| 66 | 3 | 3 |
| 67 | 3 | 4 |
| 68 | 3 | 5 |
| 69 | 3 | 6 |
| 70 | 4 | 2 |
| 71 | 4 | 3 |
| 72 | 4 | 4 |
| 73 | 4 | 5 |
| 74 | 4 | 6 |
| 75 | 5 | 2 |
| 76 | 5 | 3 |
| 77 | 5 | 4 |
| 78 | 5 | 5 |
| 79 | 5 | 6 |
| 80 | 6 | 2 |
| 81 | 6 | 3 |
| 82 | 6 | 4 |
| 83 | 6 | 5 |
| 84 | 6 | 6 |
| 85 | 7 | 2 |
| 86 | 7 | 3 |
| 87 | 7 | 4 |
| 88 | 7 | 5 |
| 89 | 7 | 6 |
| 90 | 10 | 2 |
| 91 | 10 | 3 |
| 92 | 10 | 4 |
| 93 | 10 | 5 |
| 94 | 10 | 6 |

In the evaluation, the ten-point average roughness Rz were adjusted to have various levels through using a plurality of polishing sheets having various surface undulations and controlling a polishing speed, a polishing pushing amount and the like. In the evaluation shown above, the dynamic friction coefficient μ was set to 1.2.

In general, when the ten-point average roughness Rz is increased or decreased, the dynamic friction coefficient μ tends to be increased or decreased along with the ten-point average roughness Rz. On the other hand, in the evaluation, even when the ten-point average roughness Rz is increased or decreased, the additive was adjusted such that the dynamic friction coefficient μ tends not to be changed. Accordingly, the ten-point average roughness Rz and the dynamic friction coefficient μ have a relationship being close to flat.

Further, when the ten-point average roughness Rz has a too small value, it is difficult to attach the toner 8 to the developing roller 2, thereby making it difficult to obtain a sufficient image density. On the other hand, when the ten-point average roughness Rz has a too large value, the toner 8 tends to be attached to the developing roller 2 in an excessive amount, thereby causing the stain. Accordingly, in the evaluation, the ten-point average roughness Rz was set in a range between 2 and 6 ($2 \leq Rz \leq 6$).

In the next step, similar to the process and the condition described above, the initial stain was measured. Further, the fog was measured under the HH environment after the A3 solid printing pattern having the duty pattern of 1% (the 1% duty pattern) was printed on 20,000 sheets of paper.

Figure 20:
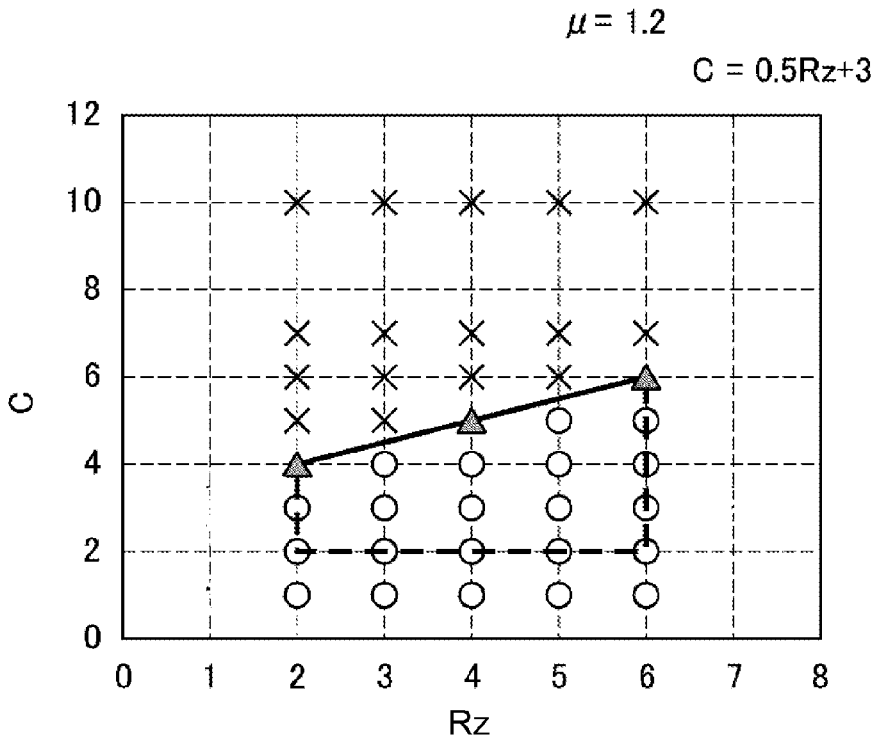
FIG. 20 is a graph showing a relationship between the content of the carbon black, the ten-point average roughness Rz of the developing roller, and the fog according to the first embodiment of the present invention.

FIG. 19 is a schematic view showing a table of evaluation results of the stain and the fog according to the first embodiment of the present invention. FIG. 20 is a graph showing a relationship between the content of the carbon black, the ten-point average roughness Rz of the developing roller 2, and the fog according to the first embodiment of the present invention.

As shown in FIGS. 19 and 20, while the optimal range of the stain was not changed much, the optimal range of the fog was shifted through adjusting the ten-point average roughness Rz. Further, a variance range in the content C per unit Rz was 0.5.

Figure 21:
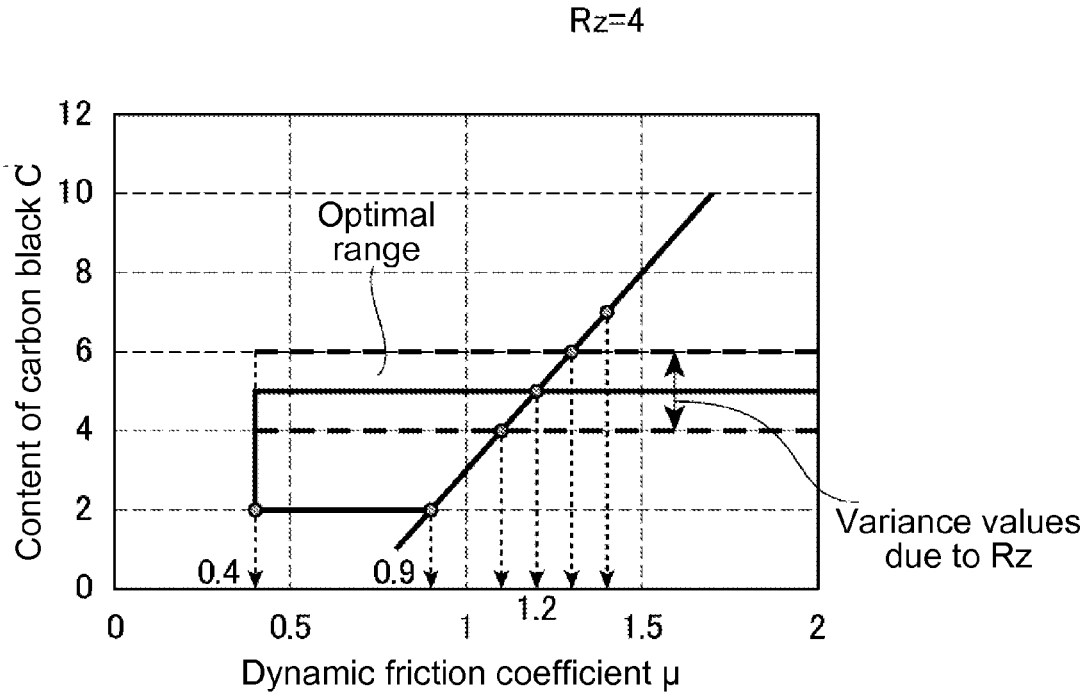
FIG. 21 is a graph showing a relationship between the dynamic friction coefficient of the developing roller, the content of the carbon black, and the ten-point average roughness Rz of the developing roller according to the first embodiment of the present invention.

FIG. 21 is a graph showing a relationship between the dynamic friction coefficient μ of the developing roller 2, the content of the carbon black, and the ten-point average roughness Rz of the developing roller 2 according to the first embodiment of the present invention. As shown in FIG. 21, when the ten-point average roughness Rz was increased or decreased, the optimal range of the content C was varied. Together with the content C, the optimal range of the dynamic friction coefficient μ was also varied.

The relationship described above can be expressed with the following equation (3).

$$(0.4 \leq \mu \leq 0.9)$$

$$2 \leq C \leq \beta$$

$$(0.9 \leq \mu \leq \alpha)$$

$$10 \times \mu - 7 \leq C \leq \beta \quad (3)$$

where α and β are the variance values due to the ten-point average roughness Rz.

Figure 22:
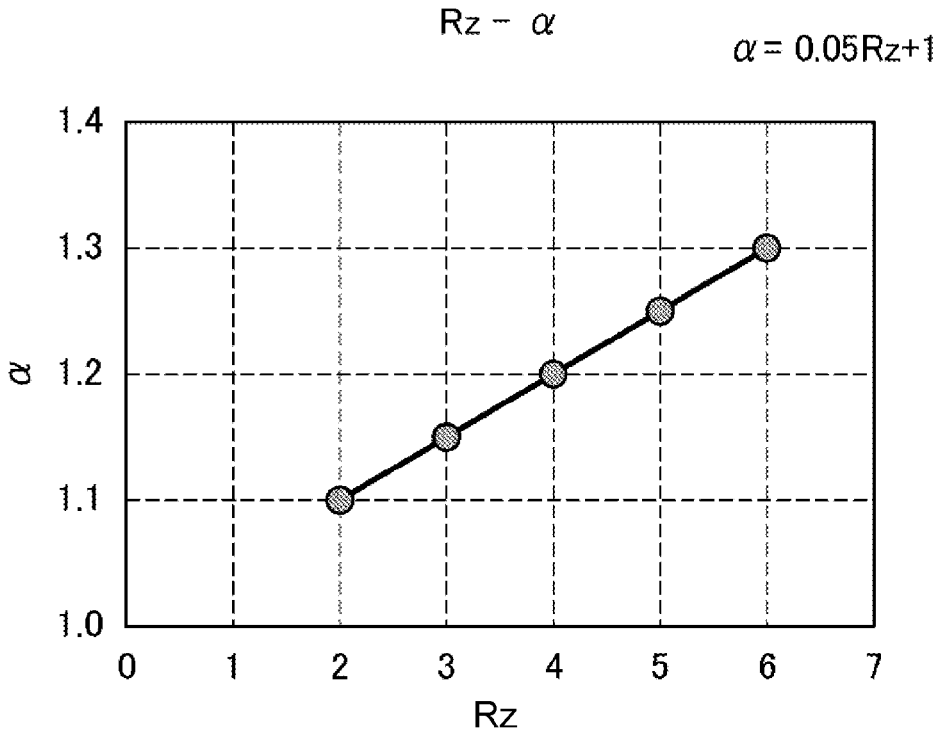
FIG. 22 is a graph showing a relationship between a variable α and the ten-point average roughness Rz of the developing roller according to the first embodiment of the present invention.
Figure 23:
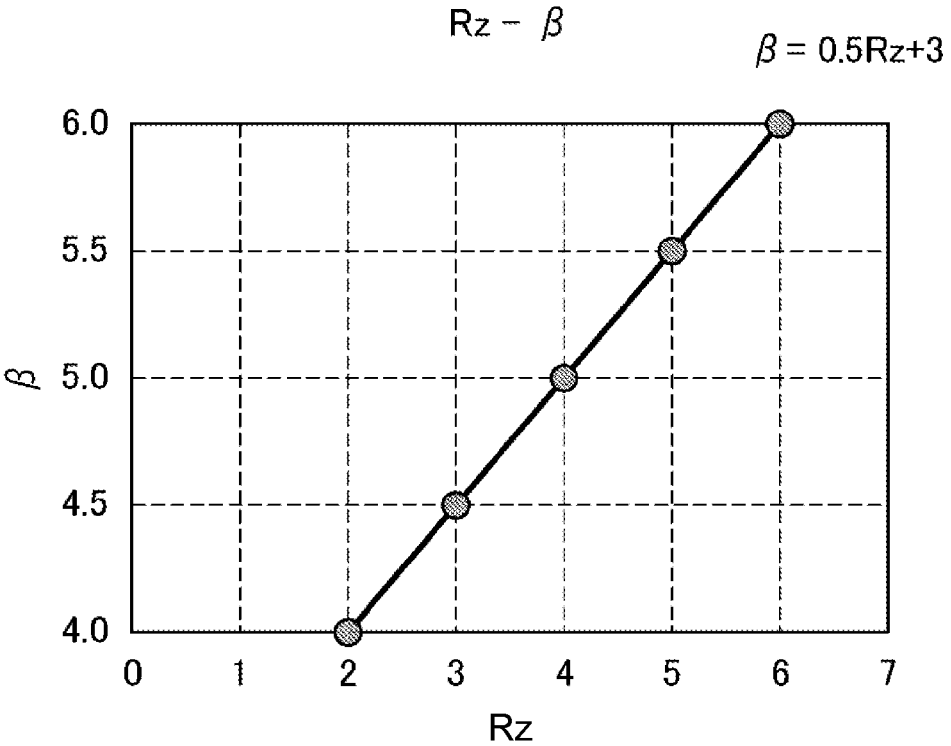
FIG. 23 is a graph showing a relationship between a variable β and the ten-point average roughness Rz of the developing roller according to the first embodiment of the present invention.

FIG. 22 is a graph showing a relationship between the variable α and the ten-point average roughness Rz of the developing roller 2 according to the first embodiment of the present invention. FIG. 23 is a graph showing a relationship between the variable β and the ten-point average roughness Rz of the developing roller 2 according to the first embodiment of the present invention.

As shown in FIGS. 22 and 23, the relationship between the variable α and the ten-point average roughness Rz and the relationship between the variable β and the ten-point average roughness Rz can be expressed with the following equation (4).

$$(0.4 \leq \mu \leq 0.9)$$

$$2 \leq C \leq 0.5 \times Rz + 3$$

$$(0.9 \leq \mu \leq 0.05 \times Rz + 1)$$

$$10 \times \mu - 7 \leq C \leq 0.5 \times Rz + 3 \quad (4)$$

As described above, in the embodiment, when the toner 8 is the synthesized toner produced with the emulsion polymerization method, the ten-point average roughness Rz of the surface layer 2*a* of the developing roller 2, the dynamic friction coefficient μ of the surface layer 2*a*, and the content C of the carbon black contained in the surface layer 2*a* are adjusted so that the following equation (4) shown above is satisfied. Accordingly, it is possible to minimize the stain, the low density image, the fog under the high humidity environment, and the toner filming with time.

Second Embodiment

A second embodiment of the present invention will be explained next. In order to minimize the fog, there is a technique in which the voltage applied to the charging roller 4 is adjusted. More specifically, when the negative charge amount on the surface of the photosensitive drum 1 is decreased, the amount of the toner 8 with positive charge capable of being attached to the photosensitive drum 1 is decreased.

In the first embodiment, the voltage of −1,000 V is applied to the charging roller 4. When the voltage applied to the charging roller 4 is decreased to −900 V or less, the stain tends to occur. Accordingly, it is preferred that the voltage greater than −900 V is applied to the charging roller 4. In the second embodiment, the fog was evaluated under conditions of various voltages applied to the charging roller 4 with respect to the developing roller 2 in the first embodiment, so that the optimal range of the fog was determined.

In the evaluation, among the evaluation samples shown in Table 2, the evaluation samples having the content C between 2 and 7 were evaluated. Further, the developing roller 2 having the ten-point average roughness Rz of 6 (Rz=6 μm) and the largest optimal range of the fog was used.

In the evaluation, when the voltage of −900 V as the applied voltage low limit was applied to the charging roller 4, the sample having the contact C of 7 showed the color difference ΔE of 3.86 (ΔE=3.86), thereby indicating that the fog was fair (Δ). Further, when the content C was less than 2, the brash stain was found to be poor from the results in the first embodiment, thereby omitting from the evaluation. Accordingly, in the evaluation, the content of the carbon black contained in the surface layer 2*a* of the developing roller 2 had an upper limit of 7 and a lower limit of 2.

In the evaluation, a method similar to that in the evaluation in the first embodiment under the HH environment was used at the evaluation timing after the 1% duty pattern was printed on 20,000 sheets. Further, the voltage Ch applied to the charging roller 4 was changed from −900 V to the negative side.

Figure 25:
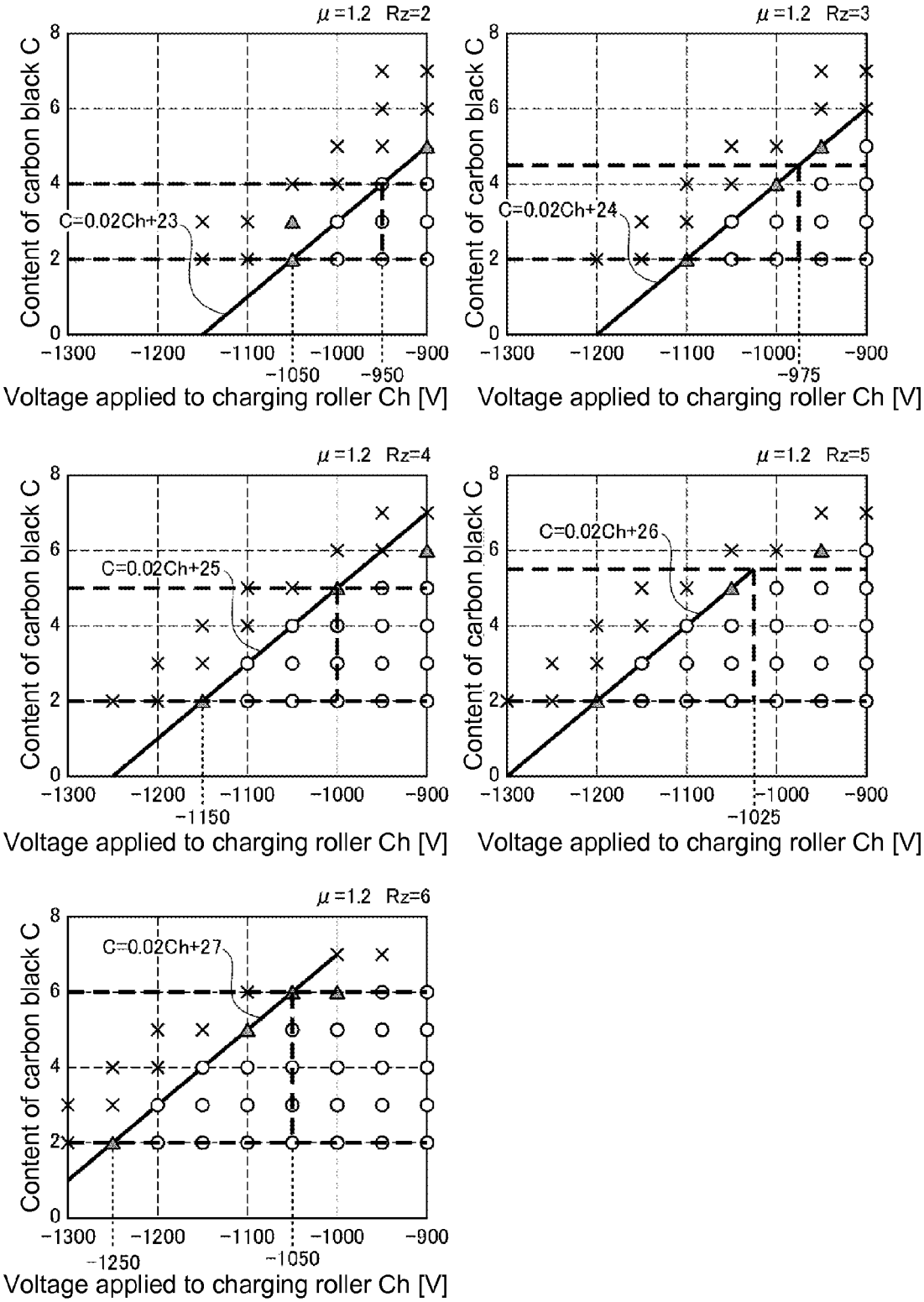
FIG. 25 is graphs showing a relationship between a content of the carbon black, the dynamic friction coefficient of a developing roller, and the fog according to the second embodiment of the present invention.

FIG. 24 is a schematic view showing a table of the evaluation results of the fog according to the second embodiment of the present invention. FIG. 25 is graphs showing a relationship between the content C of the carbon black, the dynamic friction coefficient μ of the developing roller 2, and the fog at the various levels of the ten-point average roughness Rz according to the second embodiment of the present invention.

From the results shown in FIGS. 24 and 25, the optimal ranges of the applied voltage Ch and the content C are expressed with the following equations (5) to (9):

$$Rz = 2$$

$$(-1{,}050 \leq Ch \leq -950)$$

$$2 \leq C \leq 0.02Ch + 23 \quad (5)$$

$$Rz = 3$$

$$(-1{,}100 \le Ch \le -975)$$

$$2 \le C \le 0.02Ch+24 \quad (6)$$

$$Rz=4$$

$$(-1{,}150 \le Ch \le -1{,}000)$$

$$2 \le C \le 0.02Ch+25 \quad (7)$$

$$Rz=5$$

$$(-1{,}200 \le Ch \le -1{,}050)$$

$$2 \le C \le 0.02Ch+26 \quad (8)$$

$$Rz=6$$

$$(-1{,}250 \le Ch \le -1{,}050)$$

$$2 \le C \le 0.02Ch+27 \quad (9)$$

Accordingly, when the ten-point average roughness Rz has the variables γ, δ, and ∈, the relationship can be expressed with the following equation (10):

$$(\gamma \le Ch \le 6)$$

$$2 \le C \le 0.02Ch+\in \quad (10)$$

Figure 26:
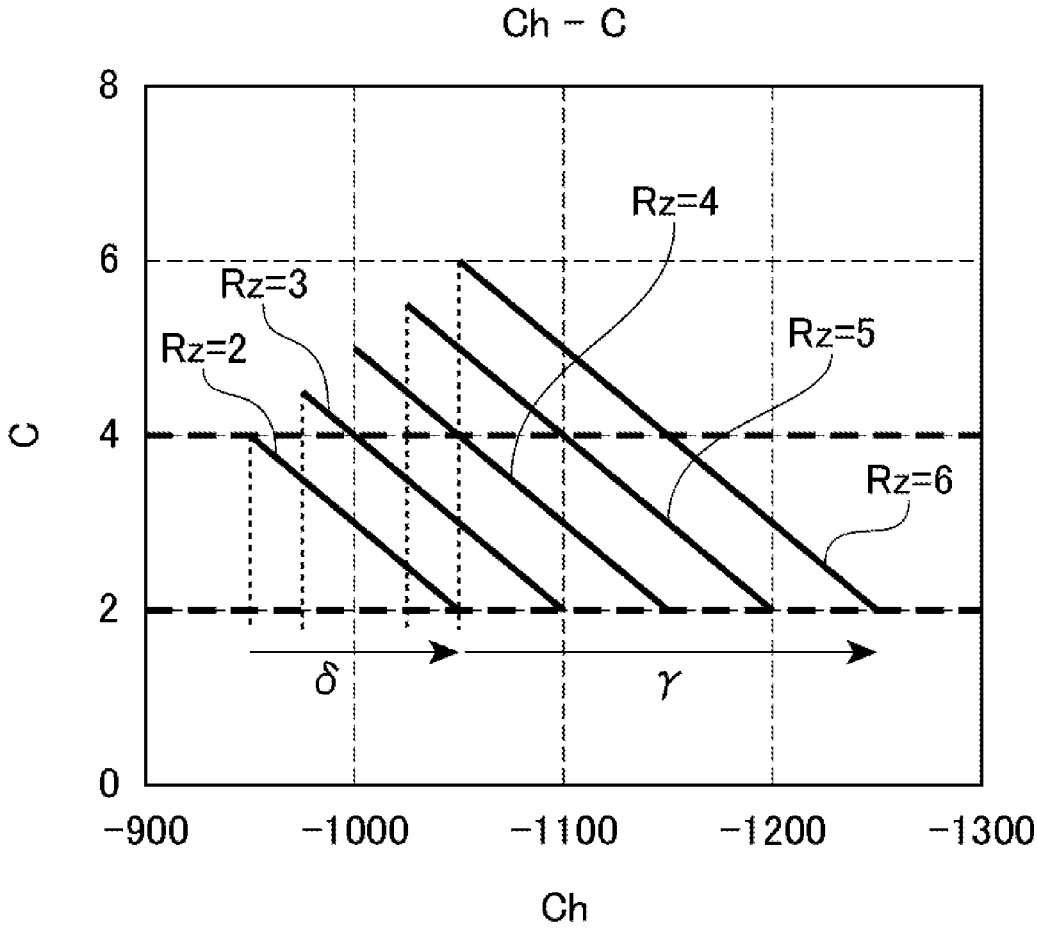
FIG. 26 is a graph showing an optimal range of the content of the carbon black and an applied voltage to the charging roller according to the first embodiment of the present invention.

FIG. 26 is a graph showing the optimal range of the content C of the carbon black and the applied voltage Ch to the charging roller 4 according to the first embodiment of the present invention. As shown in FIG. 26, when the value of the ten-point average roughness Rz is increased, the variables γ and δ are shifted toward the negative direction. Further, the equation (10) can be expressed as a primary function of the ten-point average roughness Rz. Accordingly, the equation (10) can be expressed as the following equation (11):

$$2 \le Rz \le 6$$

$$(-50 \times Rz-950 \le Ch \le -25 \times Rz-900)$$

$$2 \le C \le 0.02Ch+Rz+21 \quad (11)$$

Accordingly, when the equation (11) is satisfied, it is possible to obtain the good result in terms of the fog.

As described above, in the second embodiment, through adjusting the voltage Ch applied to the charging roller 4, it is possible to minimize the fog.

It is noted that the present invention is not limited to the first and second embodiments described above, the present invention is applicable to an image forming apparatus with an intermediate transfer method. Further, in addition to the printer, the present invention may be applicable to a copier, a facsimile, and a MFP (Multi Function Product).

The disclosure of Japanese Patent Application No. 2011-211807, filed on Sep. 28, 2011, is incorporated in the application.

While the invention has been explained with reference to the specific embodiments of the invention, the explanation is illustrative and the invention is limited only by the appended claims.

What is claimed is:

1. A developing device comprising:

a developer supporting member for supporting developer, said developer supporting member having a surface layer; and a developer layer regulating member arranged to abut against the surface layer for regulating a layer thickness of the developer on the surface layer, wherein said surface layer contains at least carbon black, said developer supporting member is composed so that the following equation (1) is satisfied when the surface layer has a dynamic friction coefficient μ between 0.4 and 0.9 (0.4≤μ≤0.9) and a ten-point average roughness Rz (μm) between 2 μm and 6 μm (2≤Rz≤6):

$$2 \le C \le 0.5 \times Rz+3 \quad (1)$$

where C is a content of the carbon black (weight parts relative to 100 weight parts of a main component of the surface layer), or said developer supporting member is composed so that the following equation (2) is satisfied when the surface layer has the dynamic friction coefficient μ and the ten-point average roughness Rz satisfy the following equation (3):

$$0.9 \le \mu \le 0.05 \times Rz+1 \quad (2)$$

$$10 \times \mu-7 \le C \le 0.5 \times Rz+3 \quad (3)$$

where Rz in the equations (1)-(3) represents only a value of the ten-point average roughness Rz of the surface layer expressed in μm.

2. The developing device according to claim 1, further comprising a developer supplying member arranged to abut against the developer supporting member with a specific pressing force for supplying the developer to the developer supporting member, said developer supplying member including a conductive supporting member and an elastic layer having a conductive silicone rubber foamed member.

3. The developing device according to claim 2, wherein said developer supplying member includes a conductive shaft and an elastic layer disposed on a circumference of the conductive shaft, wherein said elastic layer is formed of a conductive silicone rubber foamed member.

4. The developing device according to claim 3, wherein said developer supplying member has a crown shape, in which an outer diameter at an end portion thereof in a longitudinal direction thereof is larger than an outer diameter at a center portion thereof.

5. The developing device according to claim 3, wherein said conductive silicone rubber foamed member has an average cell diameter between 200 and 500 μm.

6. The developing device according to claim 1, wherein said developer supporting member is configured to support the developer produced with an emulsion polymerization method.

7. The developing device according to claim 1, wherein said surface layer is formed of a urethane resin as the main component thereof.

8. The developing device according to claim 1, wherein said developer supporting member further includes an elastic layer covered with the surface layer.

9. An image forming apparatus comprising the developing device according to claim 1; a transfer unit for transferring a developer image developed with the developing device to a recording medium; and a transportation unit for transporting the recording medium to the transfer unit.

* * * * *